US005402149A

United States Patent [19]

Amagami et al.

[11] Patent Number: 5,402,149

[45] Date of Patent: Mar. 28, 1995

[54] MATRIX DISPLAY APPARATUS, METHOD AND CIRCUIT FOR DRIVING SAME AND COMPUTER HAVING SAME

[75] Inventors: Atsuhiko Amagami, Yamato; Nobuo Aruga, Machida, both of Japan

[73] Assignee: International Business Machines Corporation, Armonk, N.Y.

[21] Appl. No.: 73,837

[22] Filed: Jun. 8, 1993

[30] Foreign Application Priority Data

Jun. 8, 1992 [JP] Japan ..... 4-147311

[51] Int. Cl.[6] ..... G09G 1/06

[52] U.S. Cl. ..... 345/132; 345/100; 345/55

[58] Field of Search ..... 358/140, 180, 241; 345/138, 87, 100, 98, 55, 132; 348/441, 793, 458, 580, 240, 792, 800

[56] References Cited

U.S. PATENT DOCUMENTS

| | | | |
|---|---|---|---|
| 4,402,012 | 8/1983 | Knight | 348/580 |
| 4,694,349 | 9/1987 | Takeda et al. | 348/793 |
| 4,698,673 | 10/1987 | Johnson | 348/458 |
| 4,866,520 | 9/1989 | Nomura et al. | 348/441 |
| 5,083,208 | 1/1992 | Hatanaka | 348/240 |

*Primary Examiner*—Alvin E. Oberley
*Assistant Examiner*—Vivian W. Chang
*Attorney, Agent, or Firm*—David Aker

[57] ABSTRACT

To expand display data for a low-resolution matrix display apparatus to display data for a high-resolution matrix display apparatus without causing a reduction in the speed of processing and without requiring clocks of different frequencies. This is accomplished by providing intermediate value generating circuits for generating intermediate values of a plurality of adjacent display data according to an expansion ratio in a driver circuit of a matrix display apparatus and by also applying the outputs of the intermediate value generating circuits to the matrix display panel. Thus, the display data is expanded by the driver.

5 Claims, 32 Drawing Sheets

(LPs ARE ALSO INPUTTED TO K4, K3, K2, K1, AND K0 AND THEIR OUTPUTS BECOME H14*, H13*, H12*, H11*, AND H10*)

MATRIX DISPLAY APPARATUS, METHOD AND CIRCUIT FOR DRIVING SAME AND COMPUTER HAVING SAME

FIELD OF THE INVENTION

The present invention relates to a method for driving a dot matrix display apparatus, which is also called a flat display apparatus such as a liquid crystal display or a plasma display apparatus. More particularly it relates to a method for expanding display data for a low-resolution display apparatus and for displaying the expanded display data on a high-resolution display apparatus.

BACKGROUND ART

In a dot matrix display apparatus, the positions of pixels are immovable. Therefore, when display data for a dot matrix display apparatus having low resolution, that is, in which the number of pixels is small is to be displayed on a dot matrix display apparatus having high resolution, that is, in which the number of pixels is large, if the display data is not expanded, the display data is displayed on only part of the display area of the high-resolution dot matrix display apparatus and it is difficult to see the contents to be displayed. An actual example of such a case is the case where display data for the dot matrix display apparatus of 640 dots×480 lines, that is, the dot matrix display apparatus, in which one display line comprises 640 dots and the number of display lines is 480, is to be displayed on the dot matrix display apparatus of 1024 dots×768 lines. In this example, it is desirable that the display data for the dot matrix display apparatus of 640×480 should be expanded for the dot matrix display apparatus having 1024×768 or nearly 1024×768.

It is well-known that an image is obtained which has little visual difference if display data for a low-resolution display apparatus is expanded while the similarity between the brightness distribution of a high-resolution display screen after expansion and that of a low-resolution display screen before expansion is maintained. It is also well-known that the brightness of each pixel after expansion should be an intermediate value of the brightness of peripheral pixels of the corresponding positions before expansion so as to maintain the similarity of the brightness distribution and expand the display data. While there are several well-known methods for calculating an intermediate value, a method which is considered the most common of them is described in the following.

As shown in FIG. 47, when a low-resolution display screen and a high-resolution display screen with screens are of the same size superposed, pixels of low resolution and those of high resolution are slightly shifted with respect to each other. This shift is periodically repeated. As shown in FIG. 48, when attention is paid to one of the pixels of high resolution, it is obvious that the pixel of high resolution stretches over four pixels of low resolution. If it is assumed that the brightness of the pixel of high resolution is H, the brightness of the four pixels of low resolution are L0, L1, L2, and L3, and areas where the pixel of high resolution overlaps each of the four pixels of low resolution are S0, S1, S2, and S3, then the brightness (H) of the pixels of low resolution is calculated by the expression:

$$H=(S0\ L0+S1\ L1+S2\ L2+S3\ L3)/(S0+S1+S2+S3).$$

The brightness (H) of the pixel of high resolution is obtained by calculating the weighted mean of the brightness of the overlapping pixels of low resolution (L0, L1, L2, and L3) by the overlapping areas (S0, S1, S2, and S3). However, the operation for calculating an intermediate value may be based on not only the area ratio, but also a distance between centers of pixels, the square ratio of the distance and the like.

Display data may also be conventionally expanded using a software technique. In this case, display data for low resolution must be read from a memory in an information processing system, the read display data must be converted to display data for high resolution, and conversion results must be written into the memory. Therefore, this method requires a long time for processing, and for example, if the display data for low resolution successively varies, it is difficult to display the display data for high resolution corresponding to the variations.

Further, dedicated hardware for data expansion may be provided in an information processing system, and after display data is expanded in the information processing system using the hardware, the expanded display data may be sent to a dot matrix display apparatus. In this case, unless the expanded display data is sent out from said dedicated hardware at a relatively higher speed than the velocity at which display data for low resolution is sent to said dedicated hardware, the display data for high resolution cannot be displayed according to variations in the display data for low resolution. For example, if display data is also expanded for a display screen wherein resolution is expanded by a factor of 1.5, the expanded display data must be sent out using a clock having a frequency which is 1.5 times as high as the frequency of a clock used to read the original display data. Therefore, in addition to a clock for reading the display data for low resolution, a clock having a higher frequency must be provided for sending out the display data for high resolution, which makes the overall circuit configuration very complicated.

As described above, in the conventional methods for expanding display data, that is, whether software or dedicated hardware is used, the display data is first expanded in an information processing system, and then the expanded display data is sent to a dot matrix display apparatus, which causes problems in that the speed of processing is low and various clocks of different frequencies are needed.

SUMMARY OF THE INVENTION

An object of the present invention is to provide a method for expanding display data without causing the decrease in a speed of processing and without requiring clocks of different frequencies.

To attain this object, the present invention provides circuits for generating intermediate values of display data in a driver circuit of a dot matrix display apparatus to expand the display data in the driver circuit, instead of expanding the display data in an information processing system.

According to the present invention a method for driving a dot matrix display panel having a plurality of signal electrodes and a plurality of scanning electrodes crossing the signal electrodes, on which display dots are formed by the cross points of the signal electrodes and the scanning electrodes, the method being for expanding display data in the direction (horizontal direction) of display lines comprises generating intermediate values of at least part of adjacent display data and applying the values to said signal electrodes while the display data for one display lines are sequentially shifted into a shift register.

Further, according to the present invention a method for driving the dot matrix display panel having a plurality of signal electrodes and a plurality of scanning electrodes crossing the signal electrodes, on which display dots are formed by the cross points of the signal electrodes and the scanning electrodes, the method being for expanding display data in the direction (vertical direction) crossing display lines comprises generating intermediates values between display data previously applied to the signal electrodes and display data newly arranged in a shift register and applying the generated intermediate values to said signal electrodes when driving at least part of the display lines while the display data for one display line are sequentially shifted into the shift register and then are applied to the signal electrodes.

Still further, according to the present invention a circuit for driving a dot matrix display panel having a plurality of signal electrodes and a plurality of scanning electrodes crossing the signal electrodes, on which display dots are formed by the cross points of the signal electrodes and the scanning electrodes, the circuit being for expanding display data in the horizontal direction, comprises a shift register into which display data are sequentially sent according to pixel clocks until display data for one display line is arranged, to plurality of first flip flops connected in series to the shift register, second flip flops connected to the outputs of at least part of the first flip flops through intermediate value generating circuits for generating intermediate values between display data on the input sides and display data on the output sides of the first flip flops, means for simultaneously applying the pixel clocks to the first and second flip flops, and a signal electrode connected to each of the outputs of the first and second flip flops through a line data latch.

Further, according to the present invention a circuit for driving the dot matrix display panel having a plurality of signal electrodes and a plurality of scanning electrodes crossing the signal electrodes, on which display dots are formed by the cross points of the signal electrodes and the scanning electrodes, the circuit being for expanding display data in the vertical direction, comprises a shift register into which the display data are sequentially sent according to pixel clocks until display data for one display line is arranged and intermediate value generating circuits for generating intermediate values between display data previously applied to the signal electrodes and display data newly arranged in the shift register, and means for applying them to the signal electrodes.

Further, a dot matrix display apparatus according to the present invention comprises a dot matrix display panel having a plurality of signal electrodes and a plurality of scanning electrodes crossing the signal electrodes, on which display dots are formed by the cross points of the signal electrodes and the scanning electrodes, a shift register into which display data are sequentially sent according to pixel clocks until display data for one display line is arranged, a line data latch which applies the display data for one display line seat from the shift register to the signal electrodes according to line pulses, and scanning electrode driving means for selecting scanning electrodes according to line pulses, and means for expanding the display data in the horizontal direction, comprising a plurality of first flip flops connected in series to said shift register, second flip flops connected to the outputs of at least part of the first flip flops through intermediate value generating circuits which generate intermediate values between display data on the input sides and display data on the output sides of the first flip flops, means for simultaneously applying the pixel clocks to the first and the second flip flops, and a signal electrode connected to each of the outputs of the first and the second flip flops through the line data latch.

Further, another dot matrix display apparatus according to the present invention comprising a dot matrix display panel having a plurality of signal electrodes and a plurality of scanning electrodes crossing the signal electrodes, on which display dots are formed by the cross points of the signal electrodes and the scanning electrodes, a shift register into which display data are sequentially sent according to pixel clocks until display data for one display line is arranged, a line data latch which applies the display data for one display line sent for the shift register to the signal electrodes according to line pulses, and scanning electrode driving means for selecting scanning electrodes according to line pulses, and means for expanding the display data in the vertical direction including intermediate value generating circuits for generating intermediate values between display data previously applied to the signal electrodes and display data newly arranged in the shift register and for applying them to the signal electrodes.

Further, an information processing system according to the present invention comprising a CPU for performing arithmetic operations, a system memory for storing a program executed by the CPU and data used at the run time of the program, a dot matrix display apparatus having a dot matrix display panel and a circuit for driving said panel, a display controller for sending control signals and display data to said driver circuit, and a video buffer memory which holds the display data for a display apparatus having a resolution relatively lower than that of said dot matrix display panel and which is accessible from the CPU and the display controller, and means for expanding the display data in the horizontal direction including a shift register into which the display data are sequentially sent according to pixel clocks until display data for one display line is arranged and by providing to the shift register a plurality of first flip flops for sequentially shifting said display data sent from the display controller, intermediate value generating circuits which generate intermediate values of at least part of said adjacent display data, and second flip flops for applying said intermediate values to signal electrodes.

Further, another information processing system according to the present invention comprising a CPU for performing arithmetic operations, a system memory for storing a program executed by the CPU and data used a the run time of the program, a dot matrix display apparatus having a dot matrix display panel and a circuit for driving said panel, a display controller for sending control signals and display data to said driver circuit, and a video buffer memory which holds the display data for a display apparatus having resolution relatively lower than that of said dot matrix display panel and which is accessible from the CPU and the display controller, and means for expanding the display data in the vertical direction by providing means for generating intermediate values between display data previously applied to signal electrodes and display data newly arranged in a shift register and for applying the intermediate value to said signal electrodes, to the driver circuit.

As described above, according to the present invention, it is possible to provide such as expansion method of display data as not to cause the reduction of the speed of processing and not to require clocks of different frequencies.

DETAILED DESCRIPTION OF THE PREFERRED EMBODIMENTS

Figure 1:
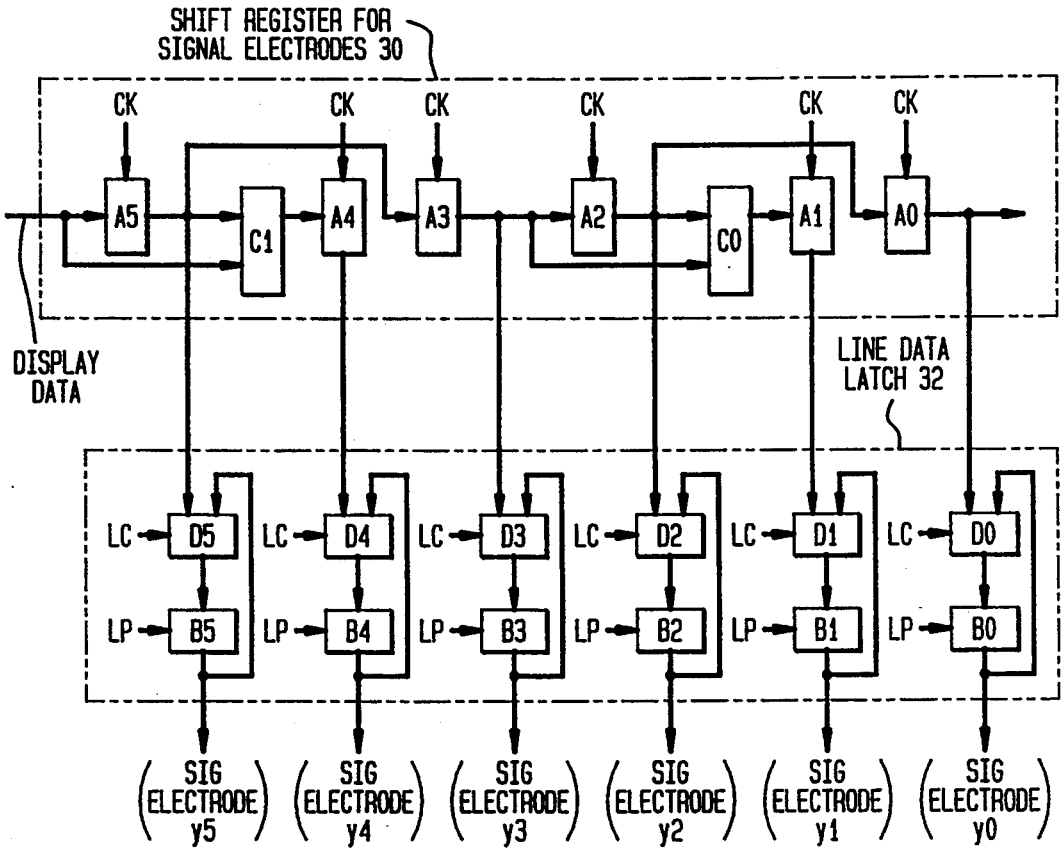
FIG. 1 is a circuit diagram showing the configuration of the main part of a driver circuit for a dot matrix display panel of a first embodiment of an information processing system having a dot matrix display apparatus according to the present invention.

First described is the relationship between arithmetic expressions for generating an intermediate value and expansion ratio s for display data. Within the range of $1<s<2$, the following three arithmetic expressions are used according to expansion ratio s. However, the following is for a single expansion unit, and in reality the following arithmetic operations are repeated according to the number of display data elements.

In the case of $1<s<1.5$, an intermediate value is generated and display data is expanded according to the following arithmetic expressions. Whether the display data is expanded in the horizontal or vertical direction, it is assumed that adjacent display data for low resolution which is formed in a line are of the brightness of L0, L1, L2, L3, . . . Lk, L(m−1), and display data for high resolution after expansion are of the brightness of H0, H1, H2, H3, . . . Hk, Hm.

$$
\begin{aligned}
H0 &= L0 \\
H1 &= (s-1)L0 + (2-s)L1 \\
H2 &= 2(s-1)L1 + (3-2s)L2 \\
H3 &= 3(s-1)L2 + (4-3s)L3 \\
&\vdots \\
Hk &= k(s-1)L(k-1) + ((k+1)-ks)Lk \\
&\vdots \\
Hm &= L(m-1)
\end{aligned}
$$

For example, in the case of s−1.25 (s=5/4), an intermediate value is generated and display data is expanded according to the following arithmetic expressions:

$$H0=L0$$

$$H1=(\tfrac{1}{4})L0+(\tfrac{3}{4})L1$$

$$H2=(\tfrac{1}{2})L1+(\tfrac{1}{2})L2$$

$$H3=(\tfrac{1}{2})L2+(\tfrac{1}{4})L3$$

$$H4=L3$$

According to the above arithmetic expressions, 4 elements (in reality, 4 n elements; where, n is the number of times when the above arithmetic operations are repeated) of the display data for low resolution are expanded into 5 elements (in reality, 5 n elements) of display data for high resolution.

Further, in the case of s=1.2 (s=6/5), an intermediate value is generated and display data is expanded according to the following arithmetic expressions:

$$H0=L0$$

$$H1=(1/5)L0+(4/5)L1$$

$$H2=(2/5)L1+(3/5)L2$$

$$H3=(3/5)L2+(2/5)L3$$

$$H4=(4/5)L3+(1/5)L4$$

$$H5=L4.$$

According to the above arithmetic expressions, 5 elements (in reality, 5 n elements) of the display data for low resolution are expanded into 6 elements (in reality, 6 n elements) of display data for high resolution.

In the case of s=1.5, an intermediate value is generated and display data is expanded according to the following arithmetic expressions:

$$H0=L0$$

$$H1=(\tfrac{1}{2})L0+(\tfrac{1}{2})L1$$

$$H2=L1.$$

According to the above arithmetic expressions, 2 elements (in reality, 2 n elements) of the display data for low resolution are expanded into 3 elements (in reality, 3 n elements) of display data for high resolution.

In the case of $1.5<s<2$, an intermediate value is generated and display data is expanded according to the following arithmetic expressions:

$$\begin{aligned}
H0 &= L0\\
H1 &= (s-1)L0+(2-s)L1\\
H2 &= L1\\
H3 &= (2s-3)L1+2(2-s)L2\\
H4 &= L2\\
H5 &= (3s-5)L0+3(2-s)L1\\
H6 &= L3\\
&\vdots\\
H(2k-1) &= (ks-(2k-1))L(k-1)+k(2-s)Lk\\
H2k &= Lk\\
&\vdots\\
H2m &= Lm
\end{aligned}$$

For example, in the case of s=1.75 (s=7/4), an intermediate value is generated and display data is expanded according to the following arithmetic expressions:

$$H0=L0$$

$$H1=(\tfrac{3}{4})L0+(\tfrac{1}{4})L1$$

$$H2=L1$$

$$H3=(\tfrac{1}{2})L1+(\tfrac{1}{2})L2$$

$$H4=L2$$

$$H5=(\tfrac{1}{4})L2+(\tfrac{3}{4})L3$$

$$H6=L3$$

According to the above arithmetic expressions, 4 elements (in reality, 4 n elements) of the display data for low resolution are expanded into 7 elements (in reality, 7 n elements) of display data for high resolution.

Further, in the case of s=1.8 (s=9/4), an intermediate value is generated and display data is expanded according to the following arithmetic expressions:

$$Ho=L0$$

$$H1=(4/5)L0+(1/5)L1$$

$$H2=L1$$

$$H3=(3/5)L1+(2/5)L2$$

$$H4=L2$$

$$H5=(2/5)L1+(3/5)L2$$

$$H6=L3$$

$$H7=(1/5)L3+(4/5)L4$$

$$H8=L4.$$

According to the above operation expressions, 4 elements (in reality, 4 n elements) of the display data for low resolution are expanded into 9 elements (in reality, 9 n elements) of display data for high resolution.

According to a first embodiment descried below, display data is expanded by 1.5 times in the horizontal and vertical directions, and according to a second embodiment, the display data is expanded by 1.25 times in the horizontal and vertical directions.

Figure 2:
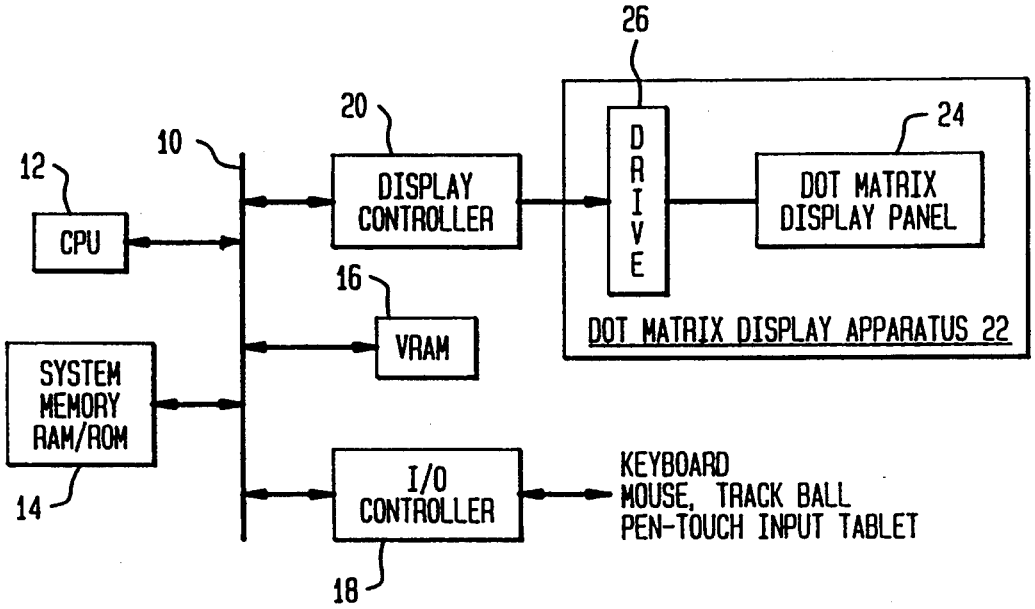
FIG. 2 is a block diagram showing the overall configuration of the first embodiment.

FIG. 2 shows a first embodiment of a data processing apparatus according to the present invention. In the figure, connected to a system bus 10 are a CPU 12, a system memory 14, a video buffer memory (VRAM) 16, an I/O controller 18, and a display controller 20. Connected to the I/O controller 18 are one or more than one of a keyboard, a mouse, a track ball, and a pen input-type tablet such as a digitizer and a touch panel sensor, and connected to the display controller 20 is a dot matrix display apparatus 22. The dot matrix display apparatus 22 comprises a dot matrix display panel 24 and a driver circuit 26. The system memory 14 is accessed by the CPU 12. The video buffer memory 16 holds display data, which is not only accessed by the CPU 12, but also read out by the display controller 20. The display controller 20 displays the contents of the display data on the dot matrix display panel 24 by sending the display data to the dot matrix display apparatus 22 in conjunction with such timing signals as pixel clocks (shift clocks), latch pulses, and frame pulses.

Figure 3:
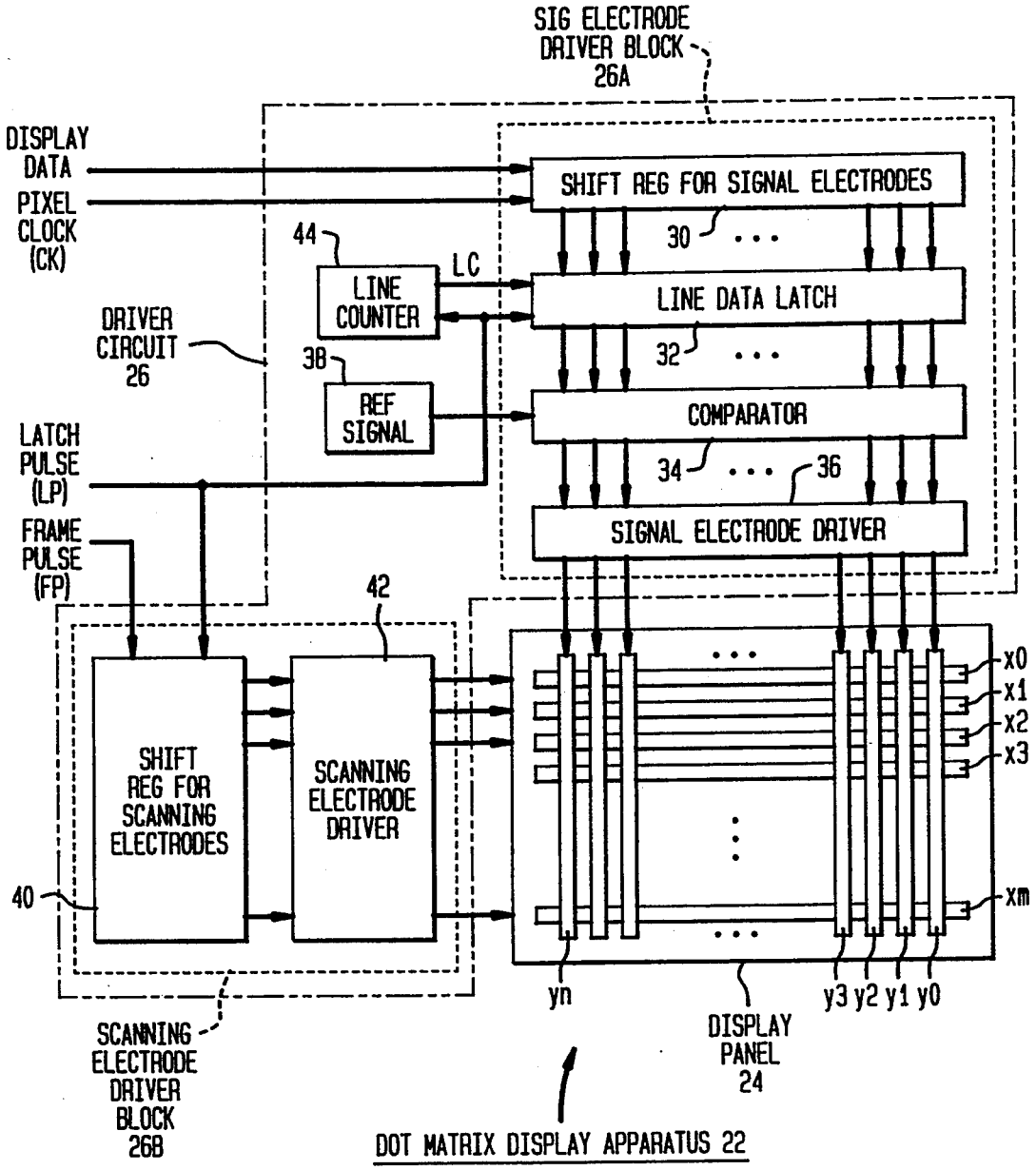
FIG. 3 is a block diagram showing the construction of a dot matrix display apparatus of the first embodiment.

FIG. 3 shows an example of the dot matrix display apparatus 22. The dot matrix display panel 24 has a plurality of signal electrodes y0, y1, y2, y3 . . . , yn and a plurality of scanning electrodes x0, x1, x2, x3 . . . , xm crossing the signal electrodes and forms display dots at the cross points of the signal electrodes and the scanning electrodes. The driver circuit 26 applies display data for one display line to the signal electrodes y0, y1, y2, y3 . . . . A scanning electrode driver block 26B applies a scan signal to only one of the scanning electrodes x0, x1, x2, x3, . . . . xm. The display data is displayed only on the scanning electrode to which the scan signal are applied.

A signal electrode driver block 26A comprises a shift register for signal electrodes 30, a line data latch 32, a comparator 34, and a signal electrode driver 36. Provided to the shift register for signal electrodes 30 are a pixel clock CK and display data. The pixel clock CK may be also called a shift clock or a dot clock. The display data, for example, data which is 4 bits per pixel, is sent as 4 bits from the display controller 20 to the shift register 30. Pixel data is shifted in the shift register 30 according to the pixel clock CK. When the pixel data is shifted in the shift register 30, as described below, the horizontal expansion of the display data is executed.

When pixel data for one display line is arranged, the pixel data is sent from the line data latch 32 to the comparator 34 according to a latch pulse LP. As described below, the vertical expansion of the display data is executed in the line data latch 32. The pixel data is compared with a predetermined reference value in the comparator 34, and a signal for displaying gradient is sent from the comparator 34 to the signal electrode driver 36. Said reference value is provided from a reference signal generating circuit 38. The signal electrodes driver 36 is a digital-to-analog converter, which outputs analog value voltage for driving the signal electrodes in accordance with digital values provided from the comparator 34. Further, provided to the line data latch 32 is a line counter pulse LC from a line counter 44.

The scanning electrode driver block 26B comprises a shift register for scanning electrodes 40 and a scanning electrode driver 42. The shift register for scanning electrodes 40 sequentially outputs scan signals to the scanning electrodes x0, x1, x2, x3 . . . , xm according to a latch pulse LP, and the scanning electrode driver 42 sequentially outputs desired voltage to the scanning electrodes x0, x1, x2, x3 . . . , xm in accordance with the scan signals from the shift register for scanning electrodes 40.

FIG. 1 shows the configuration of the shift register for signal electrodes 30 and the line data latch 32. The shift register for signal electrodes 30 includes a plurality of flip flops A0, A1, A2, A3, A4, A5 . . . . Now, it is assumed that the flip flops A0, A2, A3, and A5 of these flip flops are first flip flops and the remaining flip flops A1 and A4 are second flip flops. The first flip flops A0, A2, A3, and A5 are connected in series with each other. Respectively connected to each output of the flip flops A2 and A5, part of the first flip flops A0, A2, A3, and A5, are first intermediate value generating circuits C0 and C1 which generate intermediate values between display data on the input sides and display data on the output sides of the flip flops. If the number of signal electrodes is, for example, 1024, the number of the flip flops A0, A1, A2, A3, A4, A5 . . . is 1024 accordingly. In the flip flops A0, A1, A2, A3, A4, A5 . . . , the configuration in which two of the first flip flops is followed by one of the second flip flops, is repeated with the exception of both ends.

The first intermediate value generating circuits C0, C1, . . . are circuits which outputs the simple average value of two input values. Connected to each output of the intermediate value generating circuits C0 and C1 are second flip flops A1 and A4. The flip flops A0, A1, A2, A3, A4, A5 . . . are a kind of D-type flip flop. The pixel clock CK is simultaneously applied to all of the flip flops A0, A1, A2, A3, A4, A5 . . . . The outputs values of the intermediate value generating circuits C0, C1, . . . appear on their output lines the moment two input values are provided. Therefore, the operations of the second flip flops A2, A4 . . . for outputting intermediate values coincide with the output operations of the first flip flops A0, A1, A3, A5 . . .

The outputs of the flip flops A0, A1, A2, A3, A4, A5 . . . are connected, through the line data latch 32, to the signal electrodes y0, y1, y2, y3, y4, y5 . . . , respectively. Therefore, the average value of display data for the signal electrodes y0 and y2 is provided to the signal electrode y1, and the average value of display data for the signal electrodes y3 and y5 is provided to the signal electrode y4. In other words, a signal electrode to which the average value of display data of adjacent signal electrodes is provided appears every third signal electrode with the exception of both ends. Consequently, the display data is expanded 1.5 times in the horizontal direction.

The line data latch 32 has a plurality of flip flops B0, B1, B2, B3, B4, B5 . . . . The flip flops A0, A1, A2, A3, A4, A5 . . . of the shift register 30 are connected, through the flip flops B0, B1, B2, B3, B4, B5 . . . of the line data latch 32, to the signal electrodes y0, y1, y2, y3, y4, y5 . . . , respectively. Further, provided, respectively between the flip flops A0, A1, A2, A3, A4, A5 . . . of the shift register 30 and the flip flops B0, B1, B2, B3, B4, B5 . . . of the line data latch 32 are second intermediate value generating circuits D0, D1, D2, D3, D4, D5 . . . .

The second intermediate value generating circuits D0, D1, D2, D3, D4, D5 . . . are circuits for outputting a simple average value of two inputs the moment the two inputs are applied. One of the two inputs of the intermediate value generating circuits D0, D1, D2, D3, D4, D5 . . . is one of the outputs of the corresponding flip flops A0, A1, A2, A3, A4, A5 . . . of the shift register 30, and the other of the two inputs is one of the outputs of the corresponding flips flop B0, B1, B2, B3, B4, B5 . . . of the line data latch 32. Inputted to the second intermediate value generating circuits D0, D1, D2, D3, D4, D5 . . . is a line counter pulse LC from the line counter 44 (FIG. 3). The line counter pulse LC selectively becomes active and enables the second intermediate value generating circuits D0, D1, D2, D3, D4, D5 . . . only when driving predetermined display lines, and it disables the second intermediate value generating circuits D0, D1, D2, D3, D4, D5 . . . when driving other display lines.

For example, the line counter 44 enables the second intermediate value generating circuits D0, D1, D2, D3, D4, D5 . . . only when applying scan signals to the scanning electrodes, x1, x4, x7 . . . and driving display lines corresponding to these scanning electrodes. Therefore, display data which has an intermediate value between the display data of the scanning electrode x0 and that of the scanning electrode x2 appears in the scanning electrode x1, display data which has an intermediate value between the display data of the scanning electrode x3 and that of the scanning electrode x5 appears in the scanning electrode x4, display data which has an intermediate value between the display data of the scanning electrode x6 and that of the scanning electrode x8 appears in the scanning electrode x7, and so forth. In this way, display data which has an intermediate value between display data for two adjacent scanning electrodes appears in every third scanning electrode. Consequently, the display data is expanded by 1.5 times in the vertical direction.

In the following, the operations of the first embodiment are described in detail by referring more particularly to FIG. 4 to FIG. 21. In FIG. 4 to FIG. 21, display data L00, L01, L02, . . . . , L10, L11, L12, . . . are the display data before expansion and the display data for a dot matrix display apparatus whose resolution is relatively low. The display data before expansion is sent from the display controller 20 to the display apparatus 22. Display data H00, H01, H02, . . . , H10, H11, H12, . . . are the display data after expansion and the display data for a dot matrix display apparatus of resolution which is relatively high. The display data is expanded by the driver circuit 24. The display data L00, L01, L02, . . . are the display data which are displayed in a first display line on the dot matrix display apparatus of low resolution and the display data L10, L11, L12, . . . are the display data which are displayed in a second display line on the dot matrix display apparatus of low resolution. The display data H00, H01, H02, . . . are the display data which are displayed in a first display line on the dot matrix display apparatus of high resolution, and the display data H10, H11, H12, . . . are the display data which are displayed in a second display line on the dot matrix display apparatus of high resolution.

FIG. 4 to FIG. 12 show the state where the display data L00, L01, L02, L03, . . . for low resolution are expanded 1.5 times in the horizontal direction and converted to the display data H00, H01, H02, H03, H04, H05, . . . for high resolution. Now, the relationship between the display data L00, L01, L02, L03, . . . for low resolution and the display data H00, H01, H02, H03, H04, H05, . . . for high resolution is as follows: H00=L00, H01=(L00+L01)/2. H0=L01, H03=L02, H04=(L02+L03)/2. H05=L03, . . . . In FIG. 4 to FIG. 12, the intermediate value generating circuits D0, D1, D2, D3, D4, D5 . . . shows in FIG. 1 are omitted.

Figure 4:
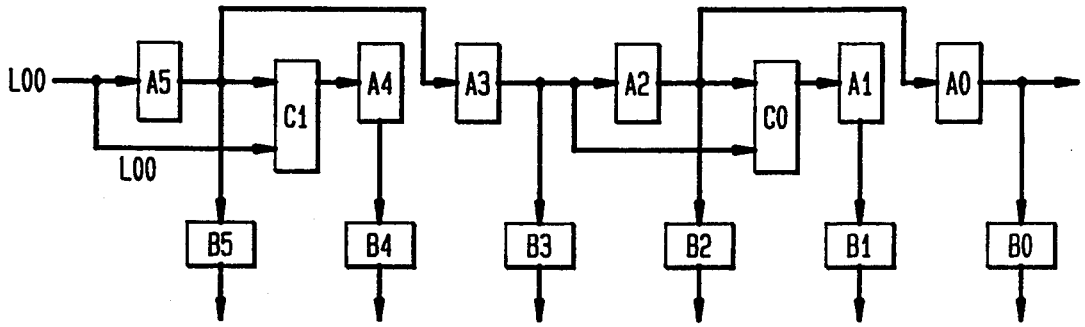
FIG. 4 is a circuit diagram showing the first stage of an operation in which display data for low resolution is expanded in the horizontal direction in the first embodiment.
Figure 5:
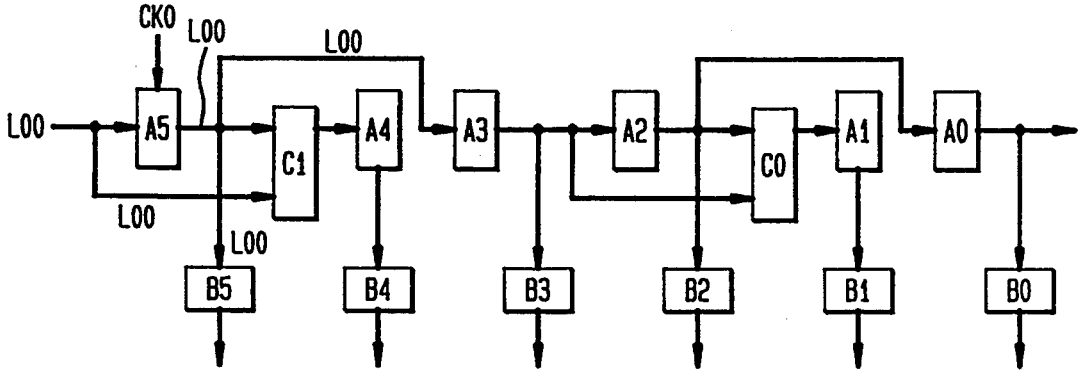
FIG. 5 is a circuit diagram showing the second stage of an operation in which the display data for low resolution is expanded in the horizontal direction in the first embodiment.
Figure 6:
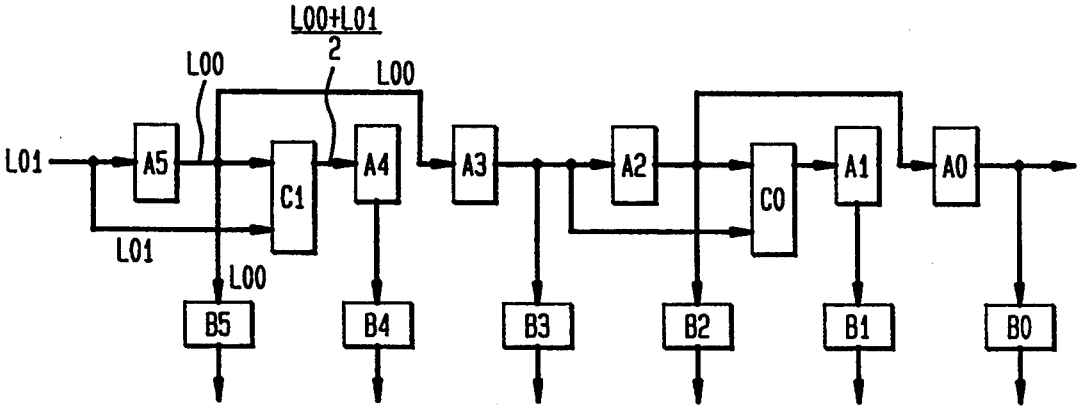
FIG. 6 is a circuit diagram showing the third stage of an operation in which the display data for low resolution is expanded in the horizontal direction in the first embodiment.
Figure 7:
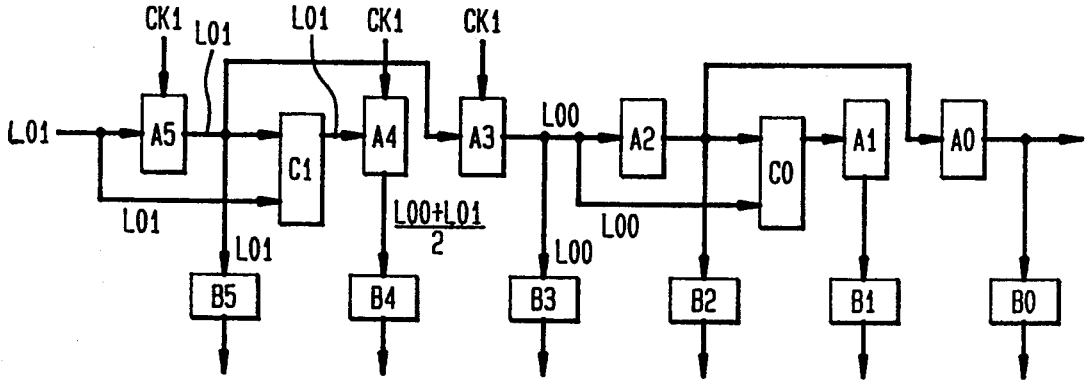
FIG. 7 is a circuit diagram showing the fourth stage of an operation in which the display data for low resolution is expanded in the horizontal direction in the first embodiment.

In FIG. 4, while the display data L00 is provided to the flip flop A5, it is provided to one of two inputs of the intermediate value generating circuit C1 on the output side of the flip flop A5. In FIG. 5, when a first pixel clock CK0 is provided to the flip flop A5, the output of the flip flop A5 becomes the display data L00. In FIG. 6, when the display data L01 is provided to the flip flop A5, the output of the flip flop A5 continues to be the display data L00, but the output of the intermediate value generating circuit C1 becomes (L00+L01)/2. in FIG. 7, when a second pixel clock CK1 is provided to the flip flops A5, A4, and A3, the output of the flip flop A5 becomes L01, the output of the flip flop A4 becomes (L00+L01)/2, and the output of the flip flop A3 becomes L00.

Figure 8:
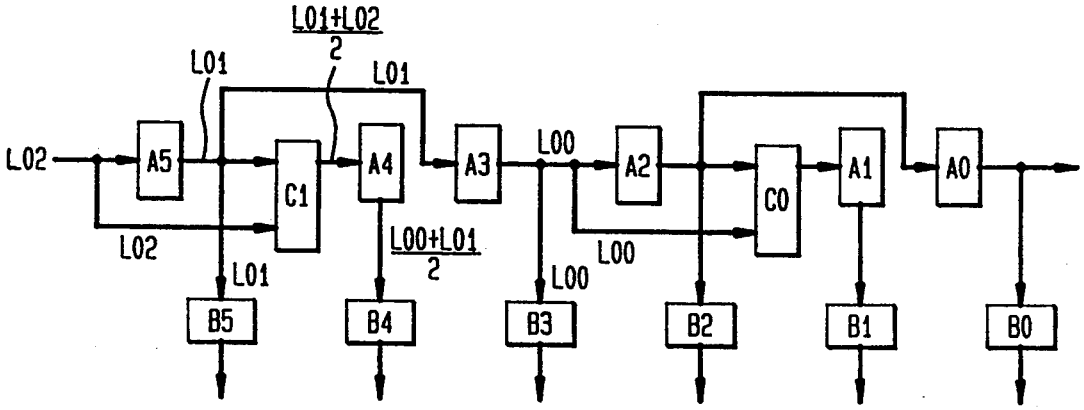
FIG. 8 is a circuit diagram showing the fifth stage of an operation in which the display data for low resolution is expanded in the horizontal direction in the first embodiment.
Figure 9:
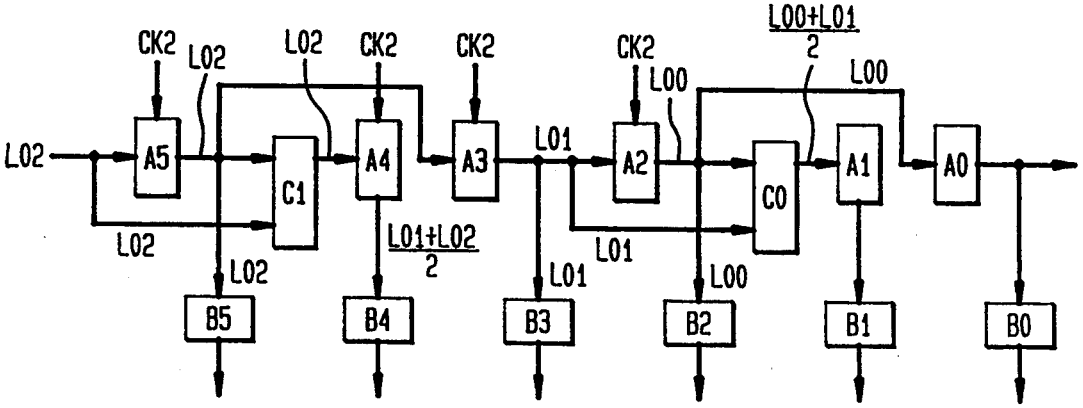
FIG. 9 is a circuit diagram showing the sixth stage of an operation is which the display data for low resolution is expanded in the horizontal direction in the first embodiment.

In FIG. 8, while the display data L02 is provided to the flip flop A5, it is provided to one of two inputs of the intermediate value generating circuit C1 on the output side of the flip flop A5. The output of the intermediate value generating circuit C1 becomes (L01+L02)/2. In FIG. 9, when a third pixel clock CK2 is provided to the flip flops A5, A4, A3, A2, and A1, the output of the flip flop A5 becomes L02, the output of the flip flop A4 becomes (L01+L02)/2, the output of the flip flop A3 becomes L01,and the output of the flip flop A2 becomes L00. Further, the output of the intermediate value generating circuit C0 becomes (L00+L01)/2.

Figure 10:
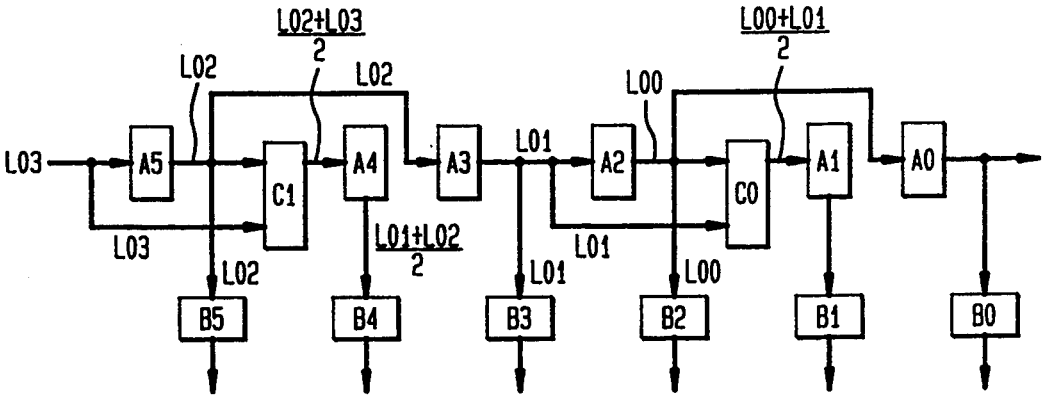
FIG. 10 is a circuit diagram showing the seventh stage of an operation in which the display data for low resolution is expanded in the horizontal direction in the first embodiment.
Figure 11:
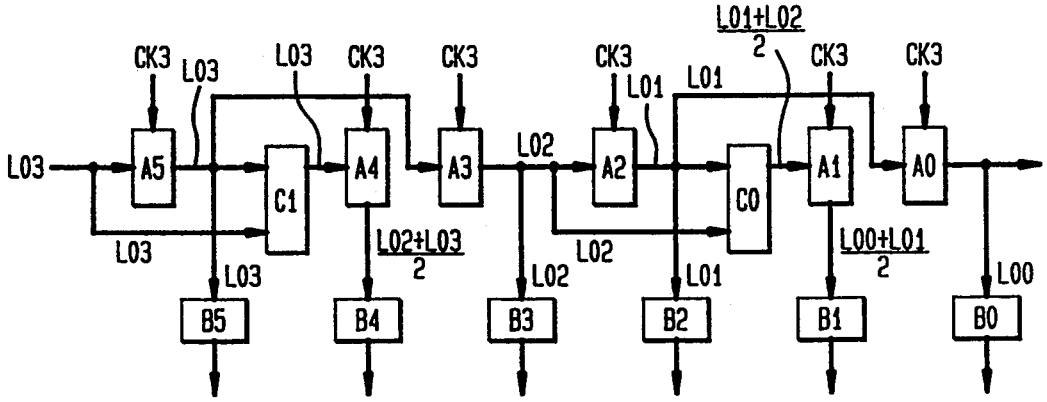
FIG. 11 is a circuit diagram showing the eighth stage of an operation in which the display data for low resolution is expanded in the horizontal direction in the first embodiment.
Figure 12:
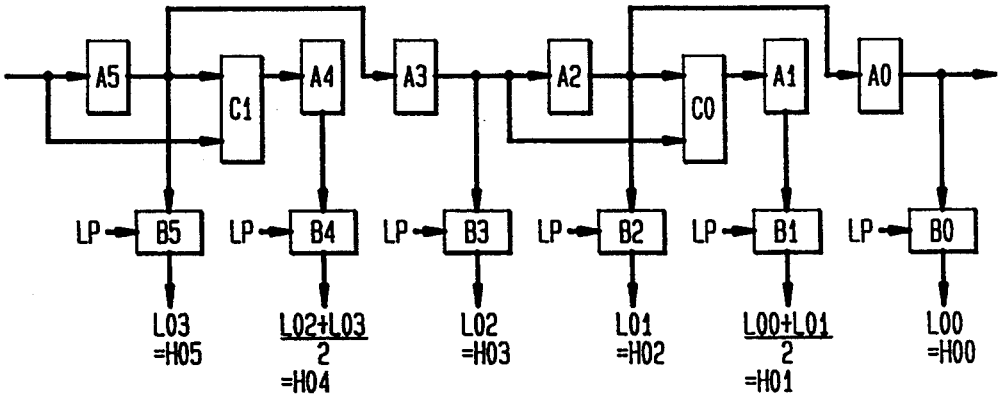
FIG. 12 is a circuit diagram showing the ninth stage of an operation in which the display data for low resolution is expanded in the horizontal direction in the first embodiment.

In FIG. 10, while the display data L02 is provided to the flip flop A5, it is provided to one of two inputs of the intermediate value generating circuit C1 on the output side of the flip flop A5. The output of the intermediate value generating circuit C1 becomes (L02+L03)/2. In FIG. 11, when a fourth pixel clock CK3 is provided to the flip flops A5, A4, A3, A2, A1, and A0, the output of the flip flop A5 becomes L03, the output of the flip flop A4 becomes (L02+L03)/2, the output of the flip flop A3 becomes L02, the output of the flip flop A2 becomes L01, the output of the flip flop A1 becomes (L00+L01)/2, and the output of the flip flop A0 becomes L00. In FIG. 12, when a latch pulse LP is simultaneously provided to the flip flops B5, B4, B3, B2, B1, and B0 of the line data latch 32, the flip flops B5, B4, B3, B2, B1, B0 output L03, (L02+L03)/2, L02, L01, (L00+L01)/2, L00, respectively.

Thus, the fourth elements of display data L03, L02, L01, and L00 for low resolution sent to the shift register 30 are expanded 1.5 times in the shift register 30 and converted to the six elements of display data L03, (L02+L03)/3, L02, L01, (L00+L01)/2, L00 for high resolution. Now, if it is assumed that the six elements of display data for high resolution are H05, H04, H03, H02, H01, and H00, H05+L03. H04+(L02+L03)/2, H03+L02, H02+L01, H01=(L00+L01)/2, and H00+L00 are established as described above. These elements of display data for high resolution are outputted to the six signal electrodes y5, y4, y3, y2, y1, and y0 of a high-resolution display apparatus. Simultaneously, a scan signal is applied to the first scanning electrode x0 corresponding to the first display line of a plurality of the scanning electrodes x0, x1, x2, x3 . . . , and display is presented in the first display line in accordance with the display data H05, H04, H03, H02, H01, and H00 for high resolution.

The number of a shift clock CK needed for data expansion is only 4 (in reality, 4 times n; where, n is the number of times when the configuration of illustrated sections of circuits is repeated in an actual circuit) of a first shift clock to a fourth shift clock, CK0 to CK3. That is, while the display data is expanded by 1.5 times, the number of the shift clocks CK needed for an operation is the same as in the case where the display data is shifted in the shift register 30 without being expanded. As described above as an explanation of the prior art, if the display data is expanded by 1.5 times using any means and then sent to a shift register, 6 pieces (in reality, 6 times n) of the display data are shifted as a result. Therefore, in such prior art, the number of the shift clocks CK needed for an operation is 6 (in reality, 6 times n) and it is difficult to make the content of the display follow the variations in the display data before expansion. On the contrary, according to said embodiment, since the display data before expansion can be expanded by 1.5 times using only the number of the shift clocks needed to make it shift in a shift register without performing an expansion operation, it is easy to make the content of the display follow the variations in the display data before expansion.

FIG. 13 to FIG. 21 show the state where display data for low resolution is expanded by 1.5 times in the vertical direction, that is the display data H10, H11, H12, H13, H14, H15, . . . of a second display line for high resolution are generated by the display data L00, L01, L02, L03 . . . of a first display line for low resolution and the display data L10, L11, L12, L13 . . . of a second display line for low resolution. The generation of the display data H00, H01, H02, H03, H04, H05, . . . of a first display line for high resolution is already described. The display data H20, H21, H22, H23, H24, H25, . . . of a third display line for high resolution are generated by simply expanding the display data L10, L11, L12, L13 . . . of the second display line for low resolution in the horizontal direction.

The relationship between the display data L00, L01, L02, L03, . . . of the first display line for low resolution as well as the display data L10, L11, L12, L13 . . . of the second display line for low resolution and the display data H10, H11, H12, H13, H14, H15, . . . of the second display line for high resolution is as follows:
H10=(L00+L10)/2,
H11=(L00+L01+L30+L11)/4,
H12=(L01+L11)/2, H13=(L02+L12)/2,
H14=(L02+L03+L12+L13)/4, H15=(L03+L13), . . . .

Figure 13:
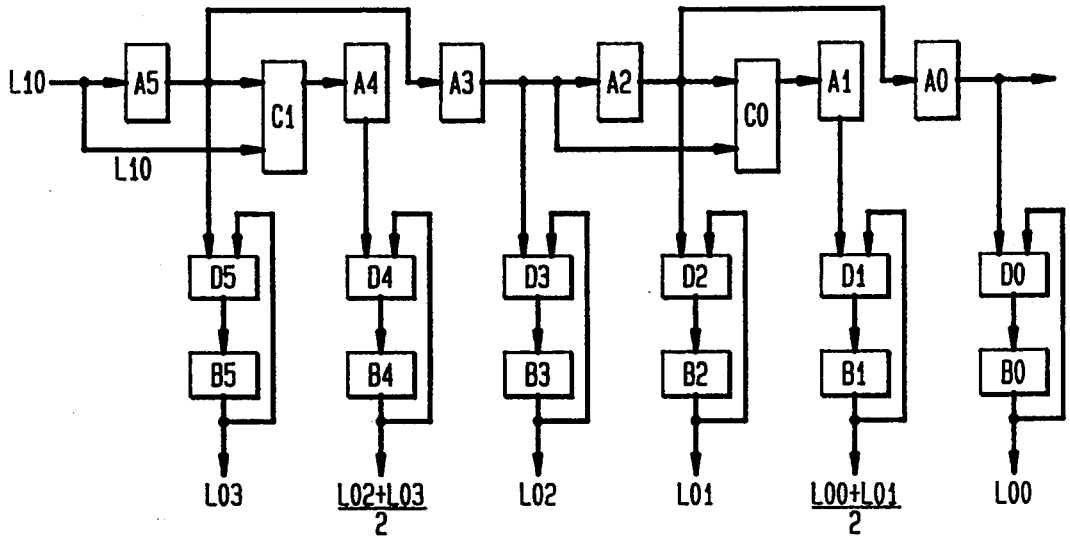
FIG. 13 is a circuit diagram showing the first stage of an operation in which the display data for low resolution is expanded also in the vertical direction in the first embodiment.
Figure 14:
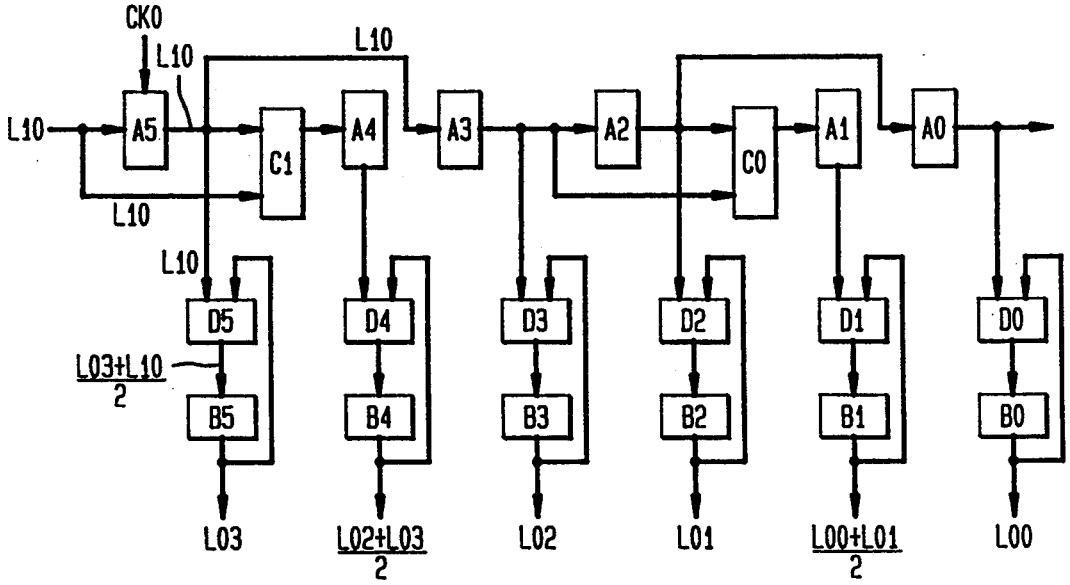
FIG. 14 is a circuit diagram showing the second stage of an operation in which the display data for low resolution is expanded also in the vertical direction in the first embodiment.
Figure 15:
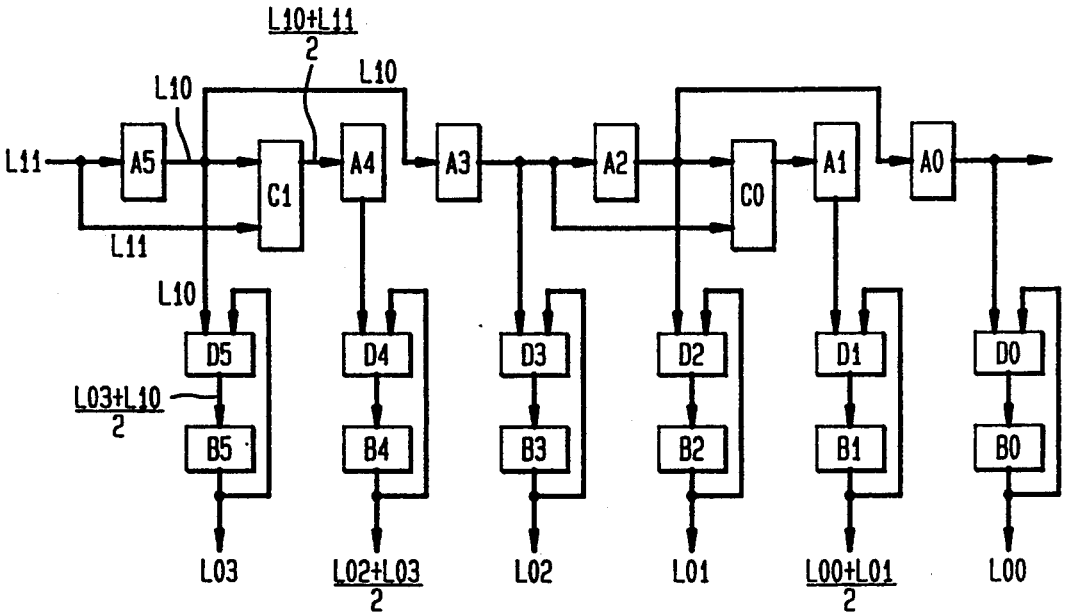
FIG. 15 is a circuit diagram showing the third stage of an operation in which the display data for low resolution is expanded also in the vertical direction in the first embodiment.
Figure 16:
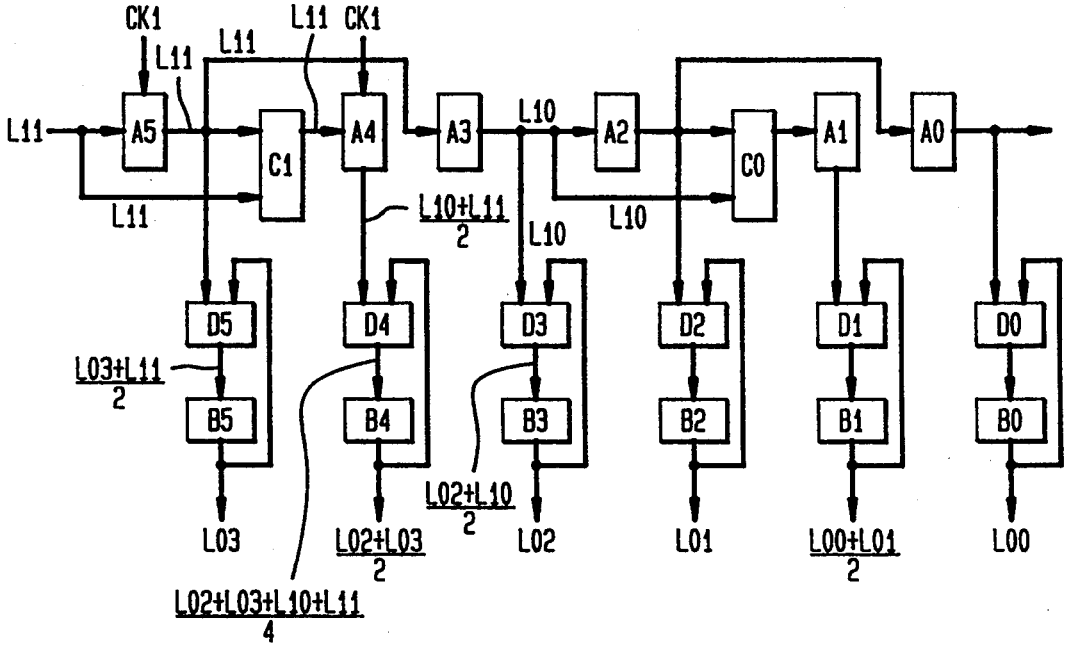
FIG. 16 is a circuit diagram showing the fourth stage of an operation in which the display data for low resolution is expanded also in the vertical direction in the first embodiment.

In FIG. 13, the flip flops B5, B4, B3, B2, B1, and B0 hold the display data for the first signal electrode x0, that is, for the first display line. In this state, while the display data L10 is provided to the flip flop A5, it is provided to one of two inputs of the intermediate value generating circuit C1 on the output side of the flip flop A5. In FIG. 14, when a first pixel clock CK0 is provided to the flip flop A5, the output of the flip flop A5 becomes the display data L10. In FIG. 15, when the display data L11 is provided to the flip flop A5, the output of the flip flop A5 continues to be the display data L10, but the output of the intermediate value generating circuit C1 becomes (L10+L11)/2. In FIG. 16, when a second pixel clock CK1 is provided to the flip flops A5, A4, and A3, the output of the flip flop A5 becomes L11, the output of the flip flop A4 becomes (L10+L11)/2, and the output of the flip flop A3 becomes L10.

Figure 17:
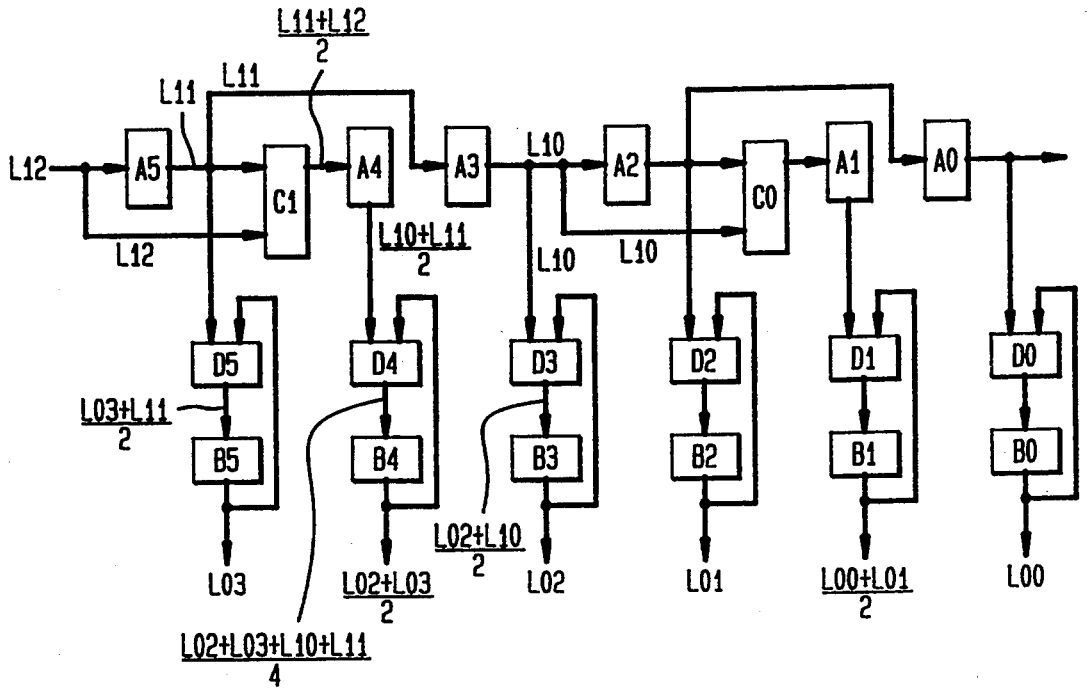
FIG. 17 is a circuit diagram showing the fifth stage of an operation in which the display data for low resolution is expanded also in the vertical direction in the first embodiment.
Figure 18:
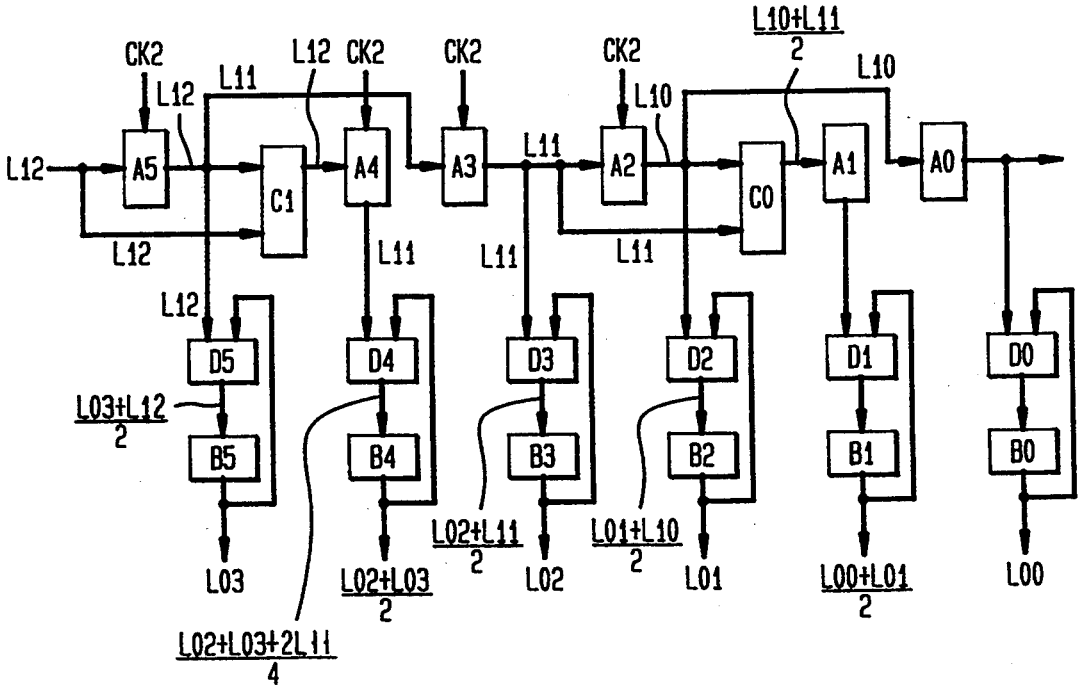
FIG. 18 is a circuit diagram showing the sixth stage of an operation in which the display data for low resolution is expanded also in the vertical direction in the first embodiment.
Figure 19:
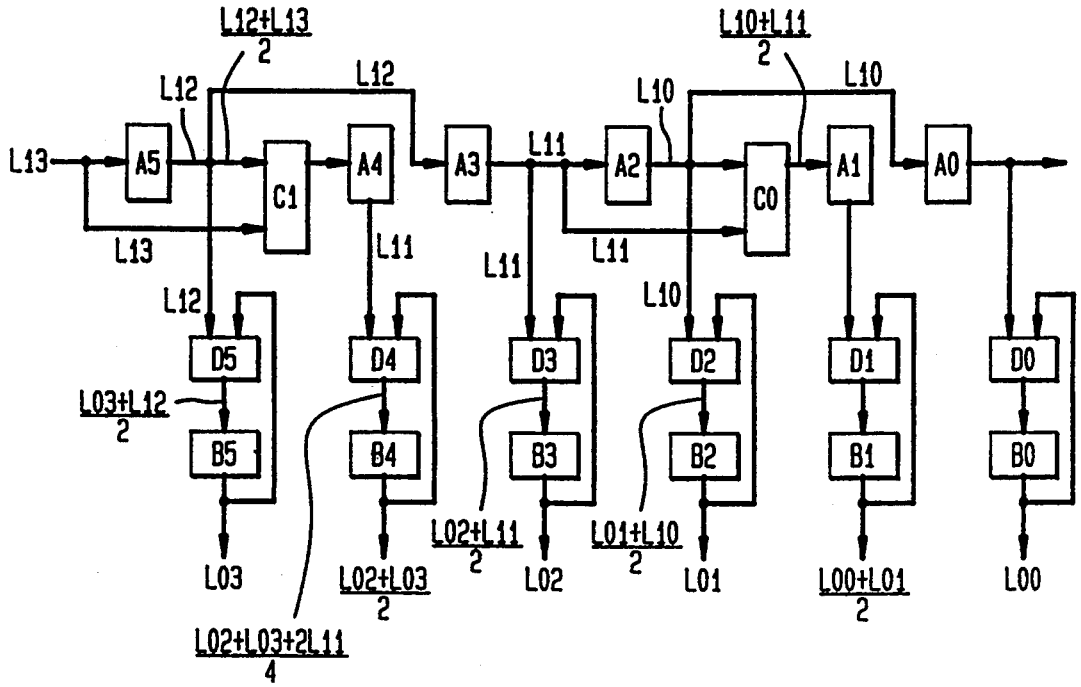
FIG. 19 is a circuit diagram showing the seventh stage of an operation in which the display data for low resolution is expanded also in the vertical direction in the first embodiment.

In FIG. 17, while the display data L12 is provided to the flip flop A5, it is provided to one of two inputs of the intermediate value generating circuit C1 on the output side of the flip flop A5. The output of the intermediate value generating circuit C1 becomes (L11+L12)/2. In FIG. 18, when a third pixel clock CK2 is provided to the flip flops A5, A4, A3, A2, and A1, the output of the flip flop A5 becomes L12, the output of the flip flop A4 becomes L11, the output of the flip flop A3 becomes L11, and the output of the flip flop A2 becomes L10. Further, the output of the intermediate value generating circuit C0 becomes (L10+L11)/2.

In FIG. 10, while the display data L13 is provided to the flip flop A5, it is provided to one of two inputs of the intermediate value generating circuit C1 on the output side of the flip flop A5. The output of the intermediate value generating circuit C1 becomes (L12+L13)/2.

Figure 20:
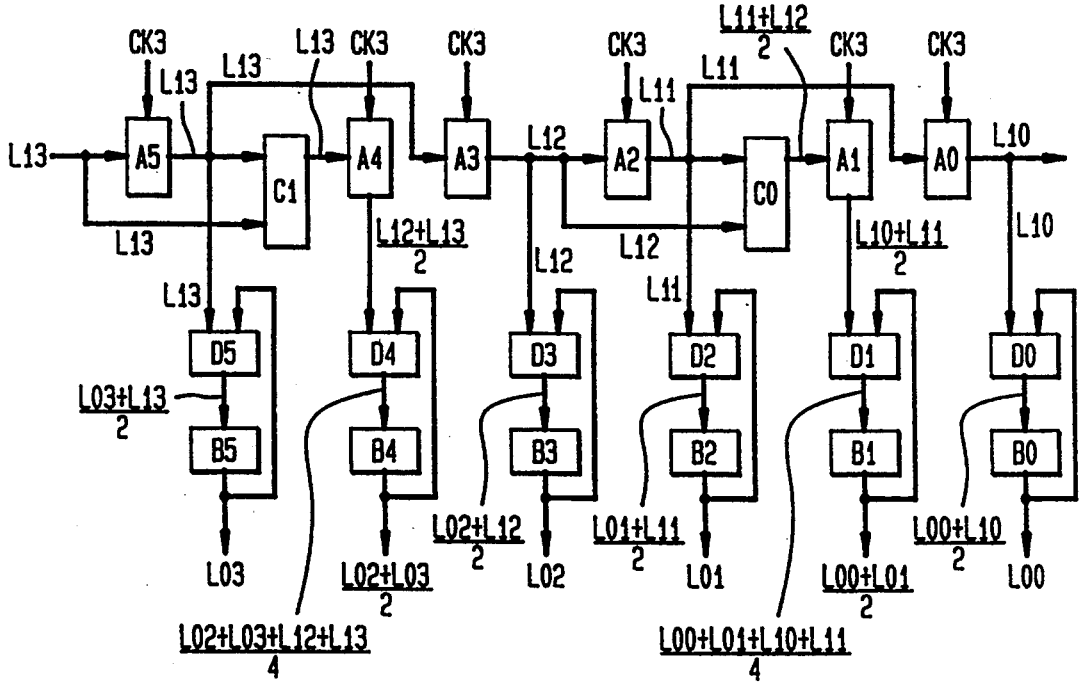
FIG. 20 is a circuit diagram showing the eighth stage of an operation in which the display data for low resolution is expanded also in the vertical direction in the first embodiment.

In FIG. 20, when a fourth pixel clock CK3 is provided to the flip flops A5, A4, A3, A2, A1, and A0, the output of the flip flop A5 becomes L13, the output of the flip flop A4 becomes (L12+L13)/2, the output of the flip flop A3 becomes L12, the output of the flip flop A2 becomes L11, the output of the flip flop A1 becomes (L10+L11)/2, and the output of the flip flop A0 becomes L10. Each of these outputs is provided to one of two inputs of each of the intermediate value generating circuits D5, D4, D3, D2, D1, and D0. Respectively provided to the other of two inputs of each of the intermediate value generating circuits D5, D4, D3, D2, D1, and D0 are the display data of the first display line L03, (L02+L03)/2, L02, L01, (L00+L01)/2, and L00. Consequently, the output of each of the intermediate value generating circuits D5, D4, D3, D2, D1, and D0 becomes (L03+L13), (L02+L03+L12+L13)/4, (L02+L12)/2, (L01+L11)/2, (L00+L01+L10+L11)/4, and (L00+L10)/2, respectively.

Figure 21:
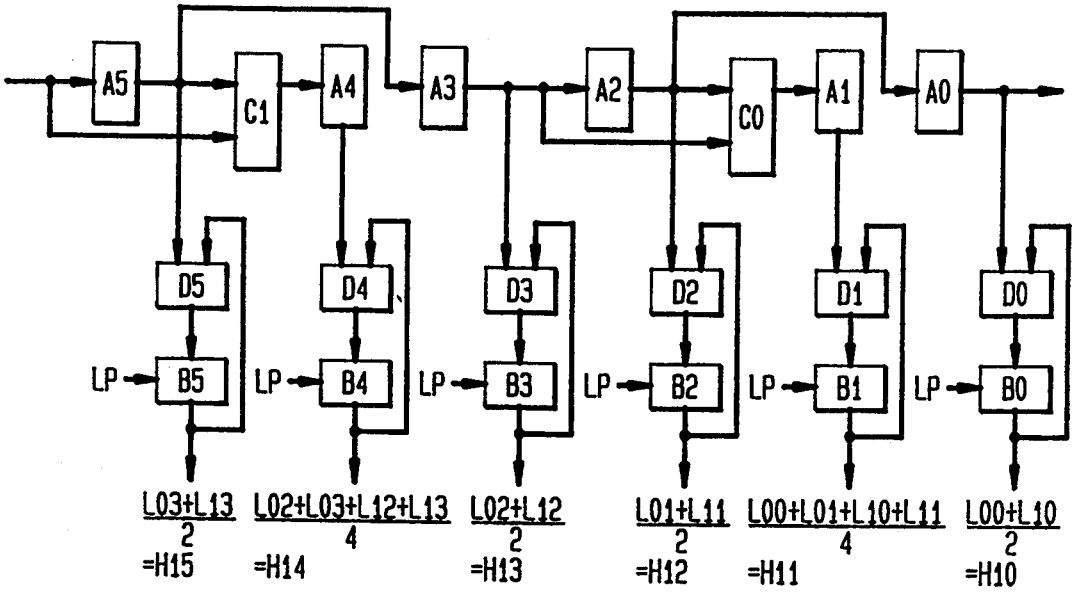
FIG. 21 is a circuit diagram showing the ninth stage of an operation in which the display data for low resolution is expanded also in the vertical direction in the first embodiment.

In FIG.21, when a latch pulse LP is simultaneously provided to each of the flip flops B5, B4, B3, B2, B1, and B0 of the line data latch 32, the flips flops B5, B4, B3, B2, B1, and B0 output (L03+L13), (L02+L03+L12+L13)/4, (L02+L12)/2, (L01+L11)/2, (L00+L01+L10+L11)/4, (L00+L10)/2, respectively.

Thus, the four elements of display data L13, L12, L11, and L10 for low resolution sent to the shift register 30 are not only expanded by 1.5 times in the horizontal direction in the first register 30, but also expanded by 1.5 times in the vertical direction in the line data latch 32, and the six elements of display data (L03+L13), (L02+L03+L12+L13)/4, (L02+L12)/2, (L01+L11)/2, (L00+L01+L10+L11)/4, (L00+L10)/2 of the second display line for high resolution are generated.

If it is assumed that the six elements of display data for high resolution are H15, H14, H13, H12, H11, and H10, H15+(L03+L13),
H14=(L02+L03+L12+L13)/2,
H13=(L02+L12)/2, H12−(L01+L11)/2,
H11=(L00+L01+L10+L11)/4, and
H10=(L00+L10)/2 are established as described above. These display data for high resolution are outputted to the six signal electrodes y5, y4, y3, y2, y1, and y0 of a high-resolution display apparatus. Simultaneously, a scan signal is applied to the second scanning electrode x1 corresponding to the second display line of a plurality of the scanning electrodes x0, x1, x2, x3 . . . . and display is presented in the second display line in accordance with the display data H15, H14, H13, H12, H11, and H10 for high resolution.

Figure 22:
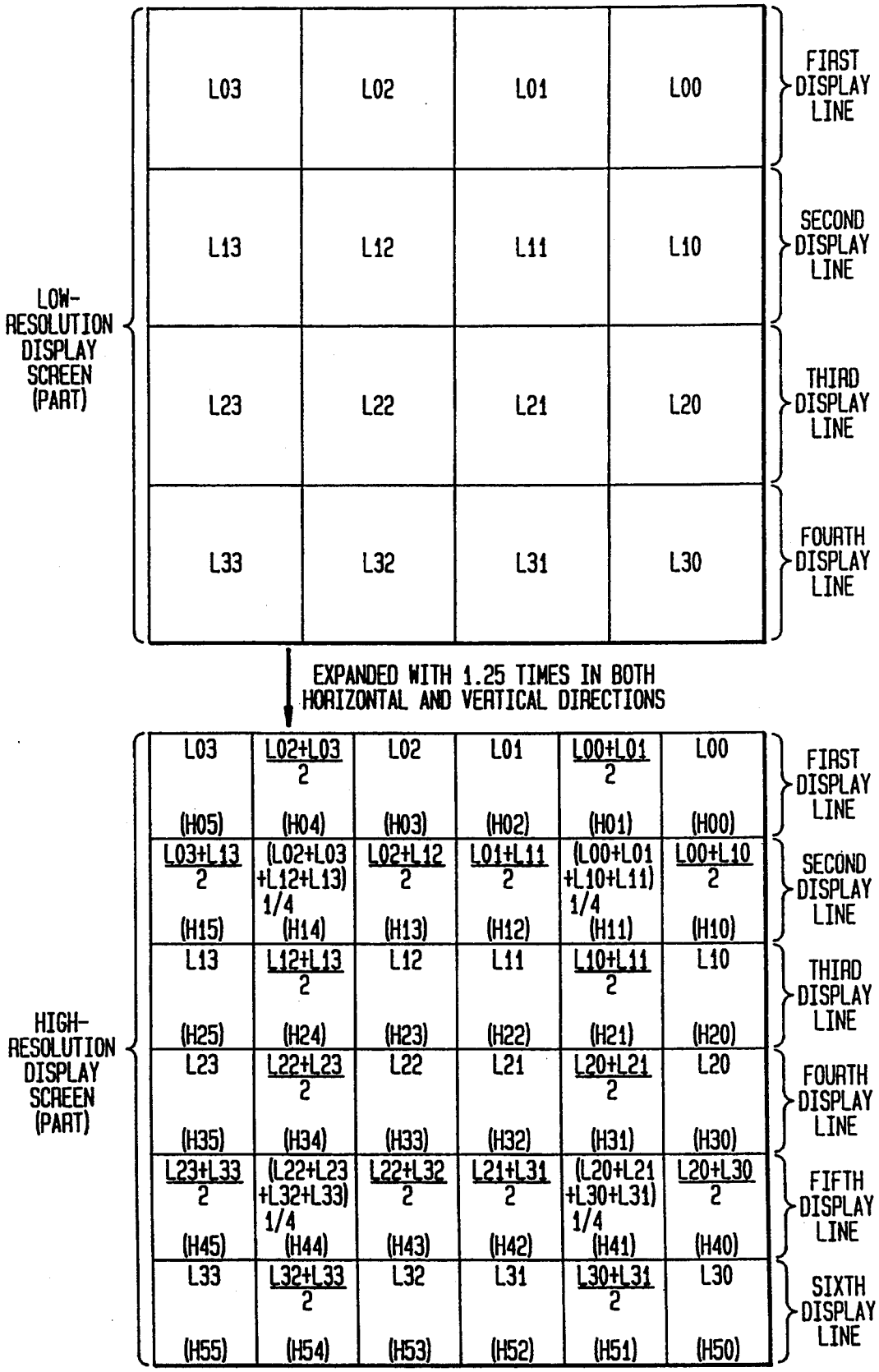
FIG. 22 is a block diagram showing a correlation between the display data for low resolution before expansion and the display data for high resolution after expansion in the first embodiment.

FIG. 22 shows the relationship between display data on a low-resolution display screen before expansion according to said embodiment and display data on a high-resolution display screen after expansion according to said embodiment. When display data is expanded, the display data for low resolution is not simply duplicated, but the display data is expanded using intermediate values of adjacent display data for low resolution, and thereby the state of brightness distribution of a display screen before expansion is similar to that of brightness distribution of a display screen after expansion, and the expansion of the display data does not cause a visual different in comparison with the original display screen.

The number of the shift clocks CK needed for data expansion is only four (in reality, 4 times n; n is the number of times when the configuration of illustrated sections of circuits is repeated in actual circuits) of a first shift clock to a fourth shift clock, CK0 to CK3. That is, while the display data is expanded by 1.5 times in the horizontal and the vertical directions, the number of the shift clocks CK needed for operations is the same as in the case where the display data is shifted in the shift resistor 30 without being expanded.

According to such a first embodiment, it is possible to expand the display data for low resolution to the display data for high resolution and make it shift register using only the number of the shift clocks needed to make it shift in the shift register without expanding the display data for low resolution. Therefore, this does not cause a reduction in a speed of processing or display during data expansion. Further, there is also an advantage that clocks of multiple frequencies are not required.

While the display data is expanded by 1.5 times in the horizontal and the vertical directions in the first embodiment, data expansion with ratios other than 1.5 times is described below. However, the description of the part which is the same as or similar to said embodiment is omitted or simplified using the same numerals or symbols as in said embodiment.

Figure 23:
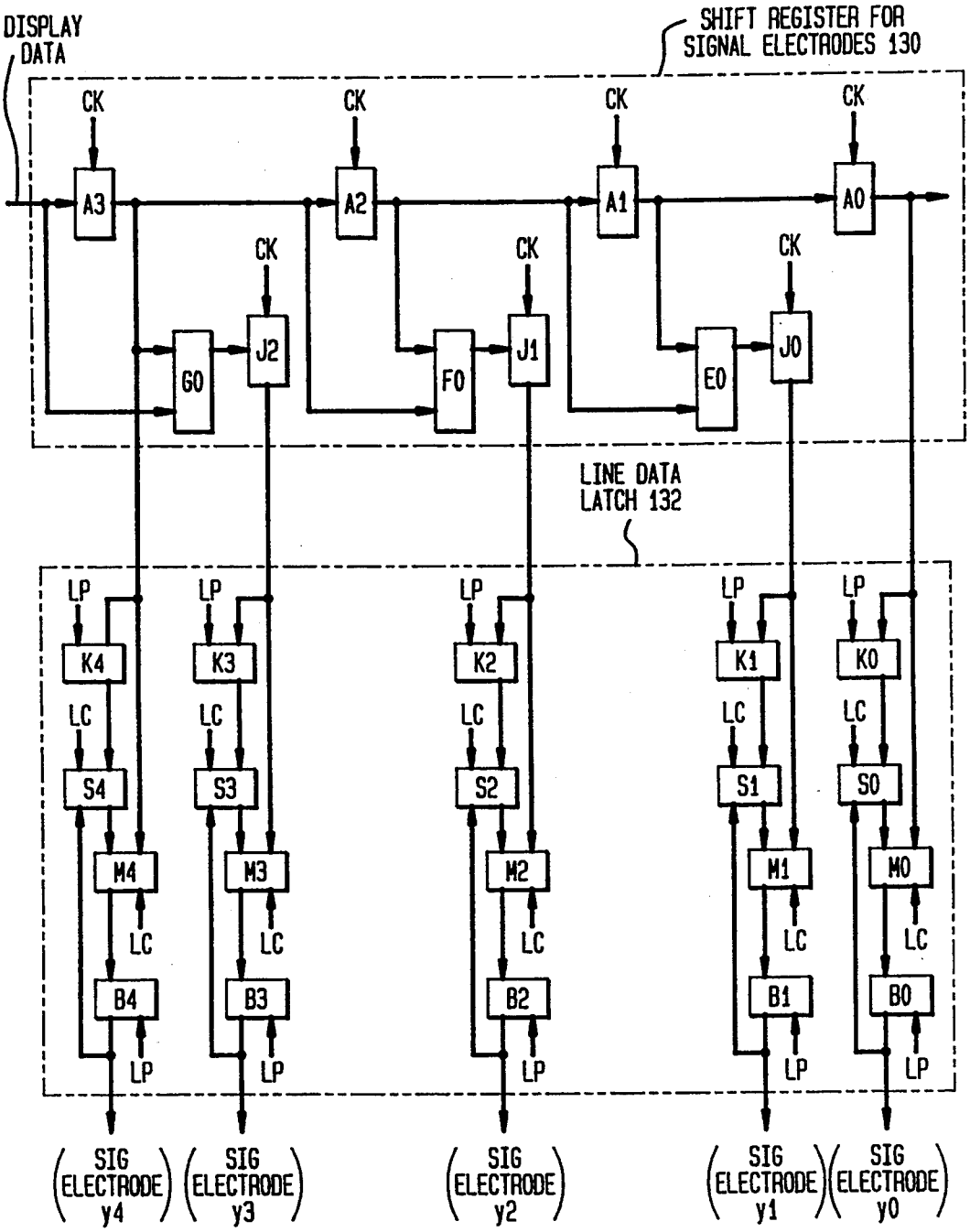
FIG. 23 is a circuit diagram showing the configuration of the main part of a driver circuit for a dot matrix display panel of a second embodiment of an information processing system having a dot matrix display apparatus according to the present invention.

FIG. 23 shows the important part of a second embodiment. In the figure, a shift register for signal electrodes 130 has the first flip flops A0, A1, A2, A3, A4 . . . and second flip flops J0, J1, J2 . . . . . The first flips flops A0, A1, A2, A3 . . . are connected in series with one another. Respectively connected to each of the outputs of the flip flops A1, A2, and A3, part of the first flip flops A0, A1, A2, A3 . . . . are intermediate value generating circuits E0, F0, and G0 for generating intermediate values between display data on the input sides and display data on the output sides of the flip flops. Though only four flip flops A0, A1, A2, A3 are shown as the first flip flops in the figure, such a configuration as shown in the figure is repeated in the shift register for signal electrodes 130.

Each of the intermediate value generating circuits E0, F0, and G0 outputs an intermediate value of two input values, which is different from one another. If it is assumed that the two input values are M and N, the intermediate value generating circuit E0 outputs $(s-1)H+(2-s)N$. The intermediate value generating circuit F0 outputs $2(s-1)H+(3-2s)N$. And, the intermediate value generating circuit G0 outputs $3(s-1)M+(4-3s)N$. In this case, $s-1.25$ is assumed. Connected to each of the outputs of the intermediate value generating circuits E0, F0, and G0 are second flip flops J0, J1, and J2. Each output of the remaining first flip flop A0 and the second flip flops J0, J1, and J2 is connected, through a line data latch 132, to the signal electrodes y0, y1, y2, y3, y4 . . . , respectively.

The line data latch 132 has a plurality of the flip flops B0, B1, B2, Be, B4 . . . . Each of the flip flops A0, J0, J1, and J2 of the shift register 130 is connected through the flip flop B0, B1, B2, B3, B4 of the line data latch 132, to the signal electrodes y0, y1, y2, y3, and y4. Further, provided between each of the flip flops A0, J0, J1, and J2 of the shift register 130 and each of the flip flops B0, B1, B2, B3, and B4 of the line data latch 132 are variable intermediate value generating circuits M0, M1, M2, M3, and M4, respectively.

The variable intermediate value generating circuits M0, M1, M2, M3, and M4 are circuits for outputting either a value obtained from simply averaging two inputs or $(s-1)M+(2-s)N$ if it is assumed that the two inputs are M and N, in response to a line counter pulse LC. However, $s-1.25$ is assumed here. One of two inputs to the intermediate value generating circuits M0, M1, M2, M3, and M4 is an output of each of the corresponding flip flops A0, J0, J1, and J2 in the shift register 130, and the other of the two inputs is an output of each of the corresponding flip flops B0, B1, B2, B3, B4 in the line data latch 132. However, an output of each of the flip flops B0, B1, B2, B3, and B4 is provided, through selectors S0, S1, S2, S3, and S4, to an input of each of the variable intermediate value generating circuits M0, M1, M2, M3, and M4.

One input of each of the selectors S0, S1, S2, S3, and S4 is an output of each of the flip flops B0, B1, B2, B3, and B4 as described above, while the other input is provided, through flips flops K0, K1, K2, K3, and K4, to an output of the flip flops A0, J0, J1, and J2 of the shift register 130. A latch pulse LP is inputted into the flip flops K0, K1, K2, K3, and K4. The flip flops K0, K1, K2, K3, and K4 are data buffers for holding a previous output of the flip flops A0, J0, J1, and J2. The selectors S0, S1, S2, S3, and S4 selectively output only one of two inputs in response to the line counter pulse LC.

FIG. 24 to FIG. 32 shows the state where the display data is expanded 1.25 times in the horizontal direction in the second embodiment. In these figures, the flip flops K0, K1, K2, K3, and K4, the selectors S0, S1, S2, S3, and S4, and the variable intermediate value generating circuits M0, M1, M2, M3, and M4 in the line data latch 132 are omitted.

Figure 24:
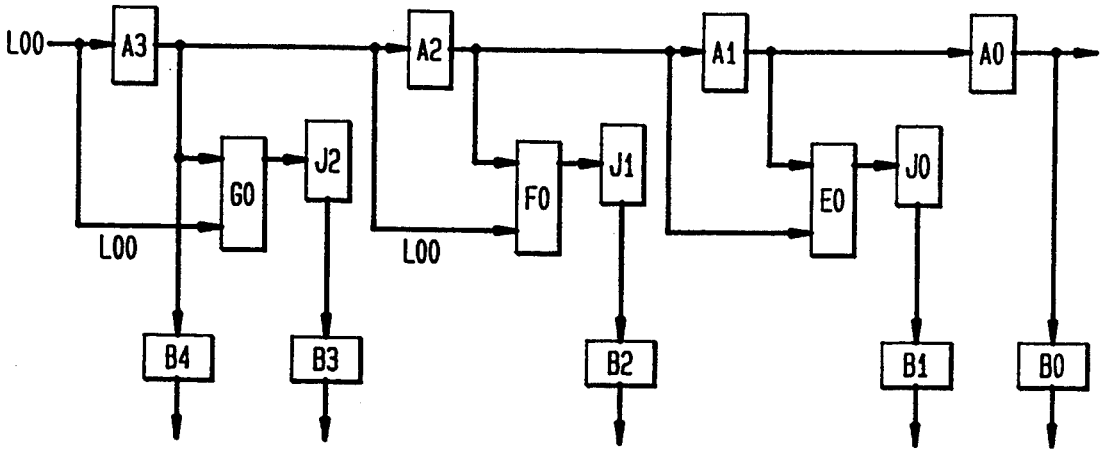
FIG. 24 is a circuit diagram showing the first stage of an operation in which the display data for low resolution is expanded in the horizontal direction in the second embodiment.
Figure 25:
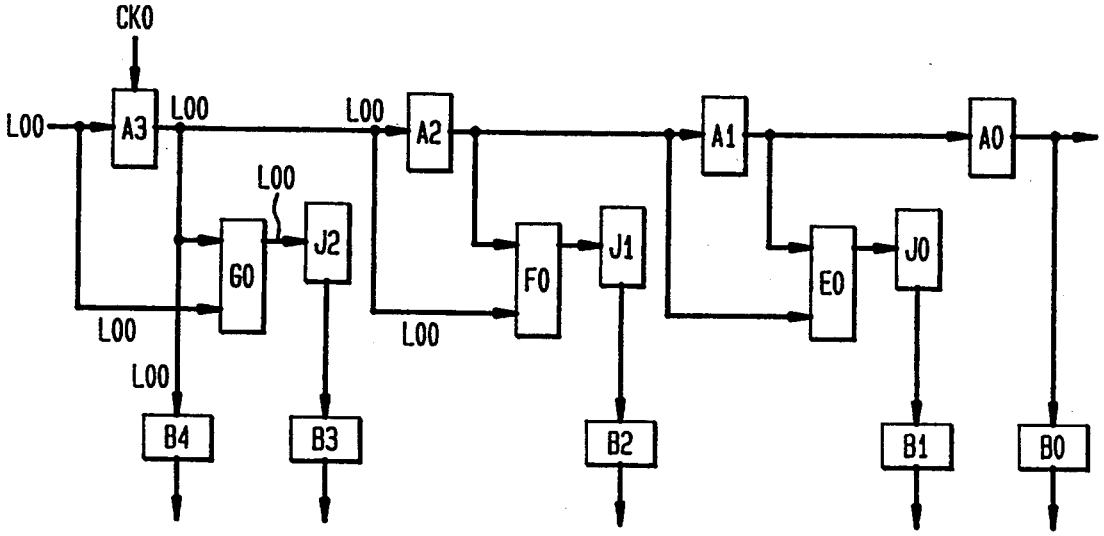
FIG. 25 is a circuit diagram showing the second stage of an operation in which the display data for low resolution is expanded in the horizontal direction in the second embodiment.
Figure 26:
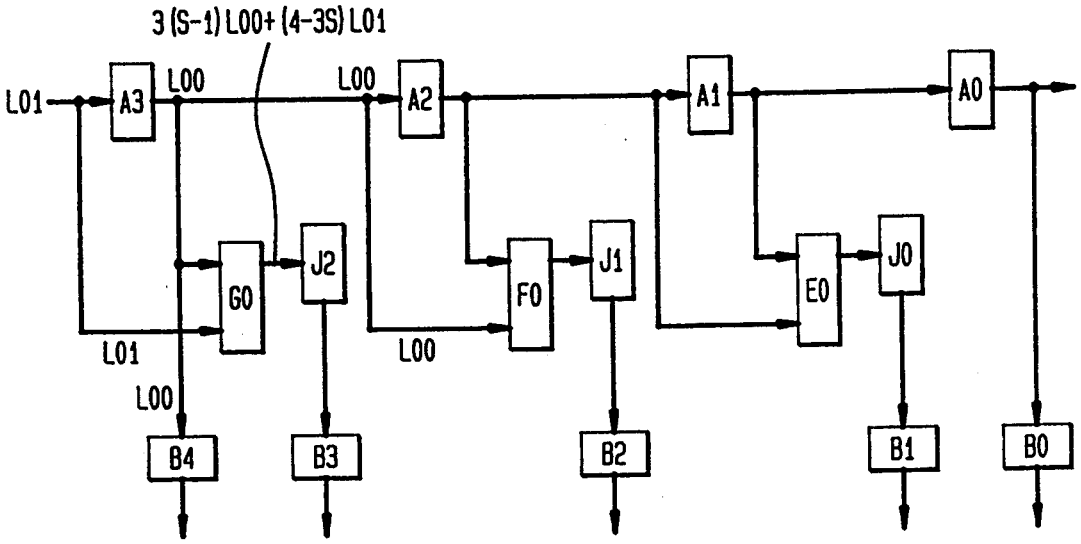
FIG. 26 is a circuit diagram showing the third stage of an operation in which the display data for low resolution is expanded in the horizontal direction in the second embodiment.
Figure 27:
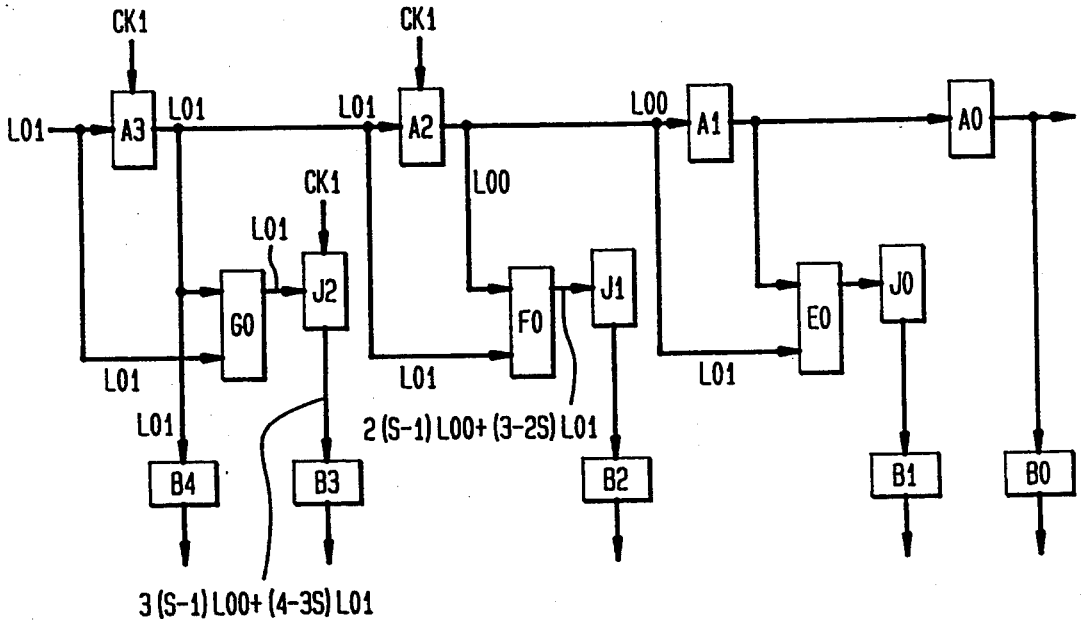
FIG. 27 is a circuit diagram showing the fourth stage of an operation in which the display data for low resolution is expanded in the horizontal direction in the second embodiment.

In FIG. 24, while the display data L00 is provided to the flip flop A3, it is provided to one of two inputs of the intermediate value generating circuit G0 on the output side of the flip flop A3. In FIG. 25, when a first pixel clock CK0 is provided to the flip flop A3, the output of the flip flop A3 becomes the display data L00. In FIG. 26, when the display data L01 is provided to the flip flop A3, the output of the flip flop A3 continues to be the display data L00, but the output of the intermediate value generating circuit G0 becomes $3(s-1)L00+(4-3s)L01$. However, $s-1.25$ is assumed here. In FIG. 27, when a second pixel clock CK1 is provided to the flip flops A3, A2, and J2, the output of the flip flop A3 becomes L01, the output of the flip flop J2 becomes $3(s-1)L00+(4-3s)L01$, and the output of the flip flop A2 becomes L00.

Figure 28:
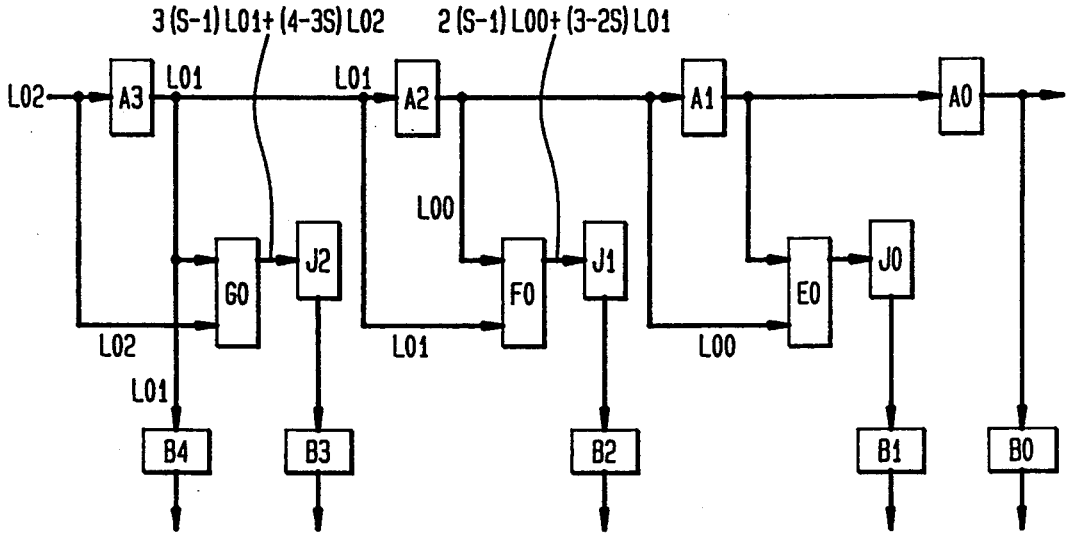
FIG. 28 is a circuit diagram showing the fifth stage of an operation in which the display data for low resolution is expanded in the horizontal direction in the second embodiment.
Figure 29:
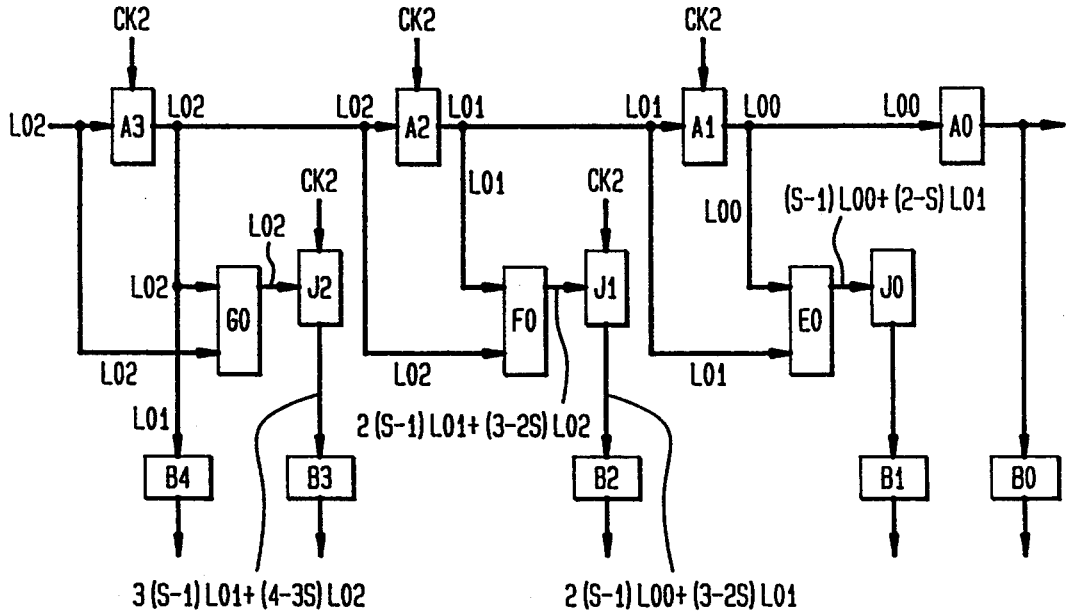
FIG. 29 is a circuit diagram showing the sixth stage of an operation in which the display data for low resolution is expanded in the horizontal direction in the second embodiment.

In FIG. 28, while the display data L02 is provided to the flip flop A3, it is provided to one of two inputs of the intermediate values generating circuit G0 on the output side of the flip flop A3. The output of the intermediate value generating circuit G0 becomes $3(s-1)L01+(4-3s)L02$. Further, one of two inputs of the intermediate value generating circuit F0 is L00, the other becomes L01, and its output becomes $2(s-1)L00+(3-2s)L01$. In FIG. 29, when a third pixel clock CK2 is provided to the flip flops A3, A2, A1, J2, and J1, the output of the flip flop A3 becomes L02, the output of the flip flop J2 becomes $3(s-1)L01+(4-3s)L02$, the output of the flip flop J1 becomes $2(s-1)L00+(3-2s)L01$, and the output of the flip flop A1 becomes L00.

Figure 32:
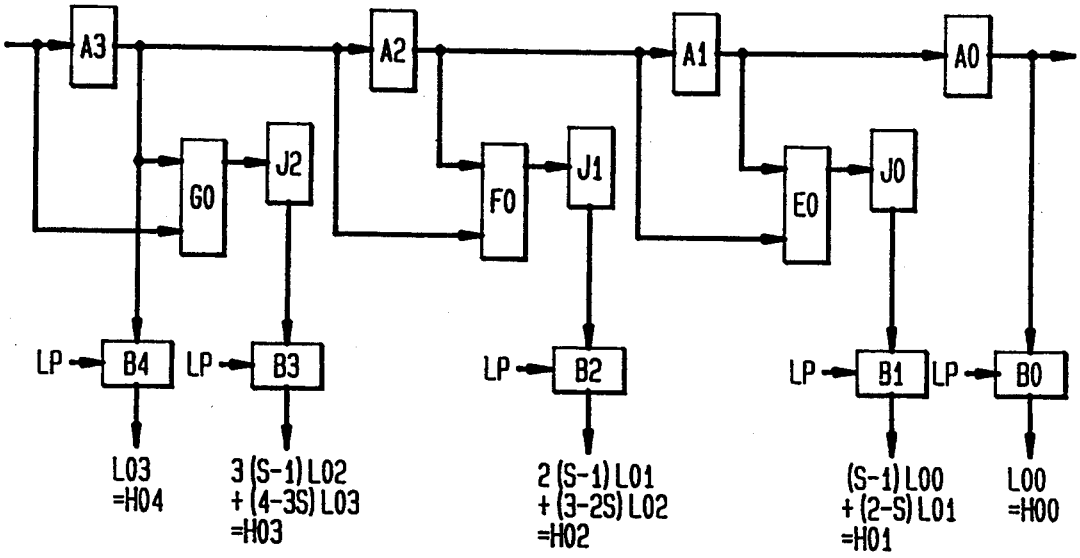
FIG. 32 is a circuit diagram showing the ninth stage of an operation in which the display data for low resolution is expanded in the horizontal direction in the second embodiment.
Figure 30:
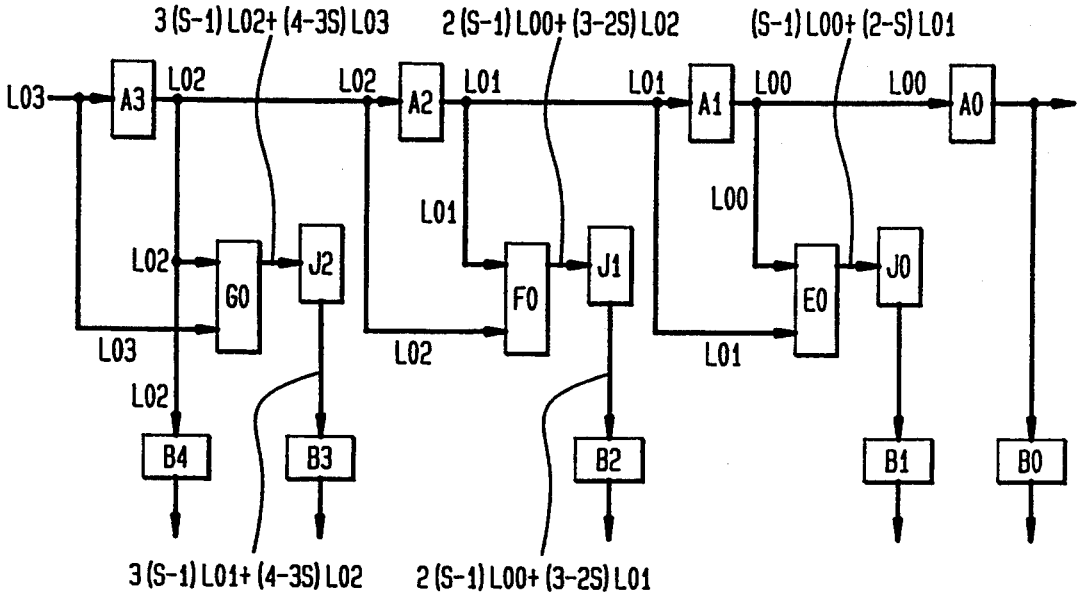
FIG. 30 is a circuit diagram showing the seventh stage of an operation is which the display data for low resolution is expanded in the horizontal direction in the second embodiment.
Figure 31:
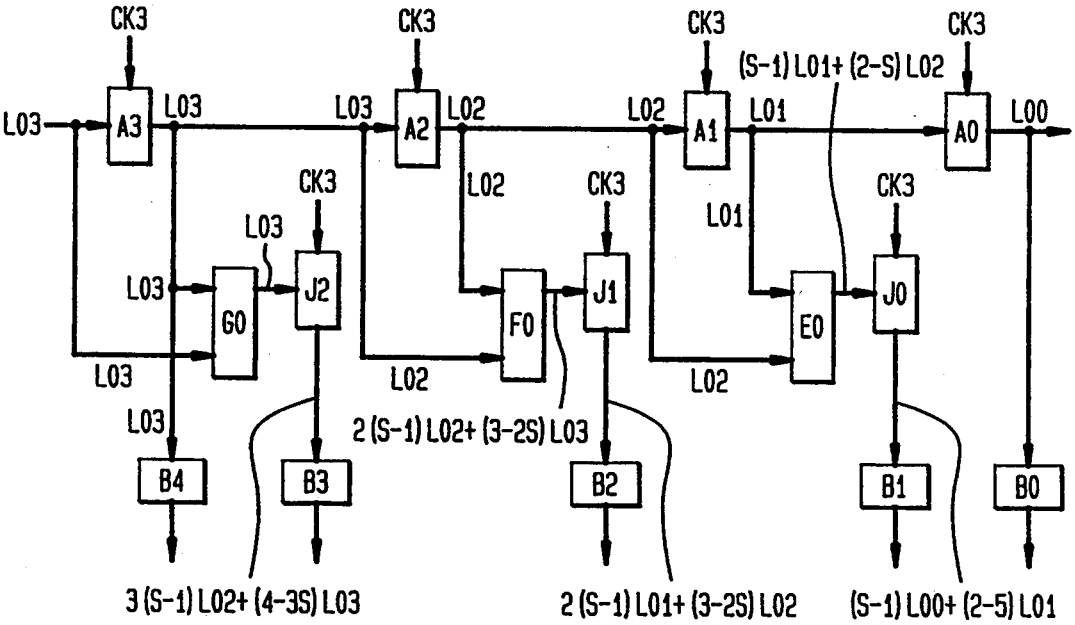
FIG. 31 is a circuit diagram showing the eighth stage of an operation in which the display data for low resolution is expanded in the horizontal direction in the second embodiment.

In FIG. 30, while the display data L03 is provided to the flip flop A3, it is provided to one of two inputs of the intermediate value generating circuit G0 on the output side of the flip flop A3. The output of the intermediate value generating circuit G0 becomes $3(s-1)L02+(4-3s)L03$. Further, the output of the intermediate value generating circuit F0 becomes $2(s-1)L01+(3-2s)L02$, and the output of the intermediate value generating circuit E0 becomes $(s-1)L00+(2-s)L01$. In FIG. 31, when a fourth pixel clock CK3 is provided to the flip flops A3, A2, A1, A0, J2, J1, and J0, the output of the flip flop A3 becomes L03, and the output of the flip flop J2 becomes $3(s-1)L02+(4-3s)L03$. Further, the output of the flip flop J1 becomes $2(s-1)L01+(3-2s)L02$, the output of the flip flop J0 becomes $(s-1)L00+(2-s)L01$, and the output of the flip flop A0 becomes L00. In FIG. 32, when a latch pulse LP is simultaneously provided to the flip flops B4, B3, B2, B1, and B0 of the line data latch 132, the flip flops B4, B3, B2, B1, and B0 output L03. $3(s-1)L02+(4-3s)L03$, $2(s-1)L01+(3-2s)L02$, $(s-1)L00+(2-s)L01$, and L00, respectively.

Thus, the four elements of display data L03, L02, L01, and L00 for low resolution sent to the shift register 130 are expanded by 1.25 times in the shift register 130 and converted to the five elements of display data L03, $3(s-1)L02+(4-3s)L03$, $2(s-1)L01+(3-2s)L02$, $(s-1)L00+(2-s)L01$, L00 for high resolution. Now, if it is assumed that the five elements of display data for high resolution are H04, H03, H02, H01, and H00, $H04=L03$, $H03=3(s-1)L02+(4-3s)L03$, $H02-2(s-1)L01+(3-2s)L02$, $H01=(s-1)L00+(2-s)L01$, and $H00=L00$ are established. These display data for high resolution are outputted to the five signal electrodes y4, y3, y2, y1, and y0 of a high-resolution display apparatus. Simultaneously, a scan signal is applied to the first scanning electrode x0 corresponding to the first display line of a plurality of the scanning electrodes x0, x1, x2, x3 . . . . and display is presented in the first display line based on the display data H04, H03, H02, H01, and H00 for high resolution.

The number of shift clocks CK needed for data expansion is only four (in reality. 4 times n; where, n is the number of times when the configuration of illustrated sections of circuits is repeated in actual circuits) of a first shift clock to a fourth shift clock, CK0 to CK3. That is, while the display data is expanded by 1.25 times, the number of the shift clocks CK needed for operations is the same as in the case where the display data is shifted in the shift register 130 without being expanded. As described above as explanation of prior art, if the display data is expanded by 1.25 times using some means and then seat to a shift register, 5 portions (in reality, 5 times n) of the display data are shifted as a result. Therefore, in such prior art, the number of the shift clocks CK needed for operations is give (in reality, 5 times n) and it is difficult to make the content of the display follow the variation in the display data before expansion. On the contrary, according to said embodiment, since the display data before expansion can be expanded by 1.25 times using only the number of the shift clocks needed to make it shift in the shift register without performing an expansion operation, it is easy to make the content of the display follow the variation in the display data before expansion.

FIG. 33 to FIG. 41 show the state where the display data H10, H11, H12, H13, H14 . . . of a second display line for high resolution are generated when the display data for low resolution is expanded by 1.25 times in the vertical direction and displayed. Now, if it is assumed that the display data of the first display line for low resolution are L00, L01, L02, L03 . . . , the display data of the second display line for low resolution are L10, L11, L12, L13 . . . , and the display data of the second display line for high resolution are H10, H11, H12, H13, H14, H15, . . . , the following relationship is established:

$$H10=(s-1)H00+(2-s)H10^*$$

$$H11-(s-1)H01+(2-s)H11^*$$

$$H12-(s-1)H02+(2-s)H12^*$$

$$H13-(s-1)H03+(2-s)H13^*$$

$$H14=(s-1)H04+(2-s)H14^*.$$

However, as described above, the following relationship is established:

$$H00=L00$$

$$H01=(s-1)L00+(2-s)L01$$

$$H02=2(s-1)L01+(3-2s)L02$$

$$H03=3(s-1)L02+(4-3s)L03$$

$$H04=L03.$$

Further, the following relationship is established:

$$H10^*=L10$$

$$H11^*=(s-1)L10+(2-s)L11$$

$$H12^*=2(s-1)L11+(3-2s)L12$$

$$H13^*=3(s-1)L12+(4-3s)L13$$

$$H14^*=L13.$$

Figure 33:
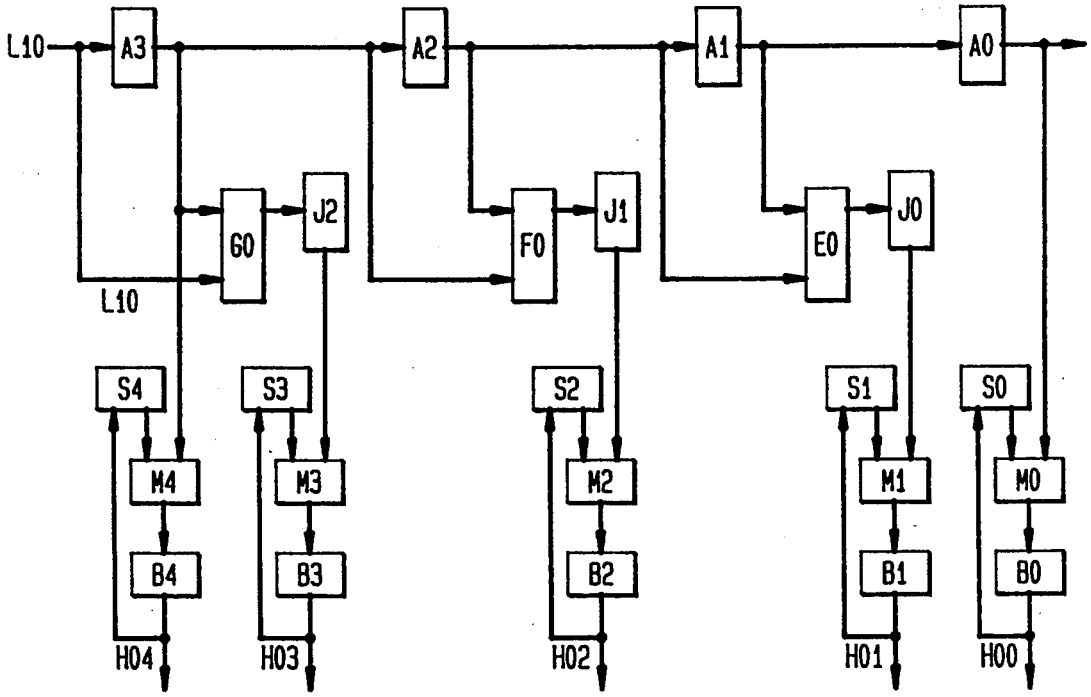
FIG. 33 is a circuit diagram showing the first stage of an operation in which the display data for low resolution is expanded also in the vertical direction and display data for a second display line is generated in the second embodiment.

In FIG. 33, each of the selectors, S4, S3, S2, S1, and S0 selects one of two inputs, which is the output of each of the flip flops B4, B3, B2, B1, and B0 in response to a line counter pulse LC. Each of the flip flops B4, B3, B2, B1, and B0 holds the display data H04, H03, H02, H01, and H00 for the first signal electrode x0, that is, for the first display line. In this state, while the display data L10 is provided to the flip flop A3, it is provided to one of two inputs of the intermediate value generating circuit G0 on the output side of the flip flop A3.

Figure 34:
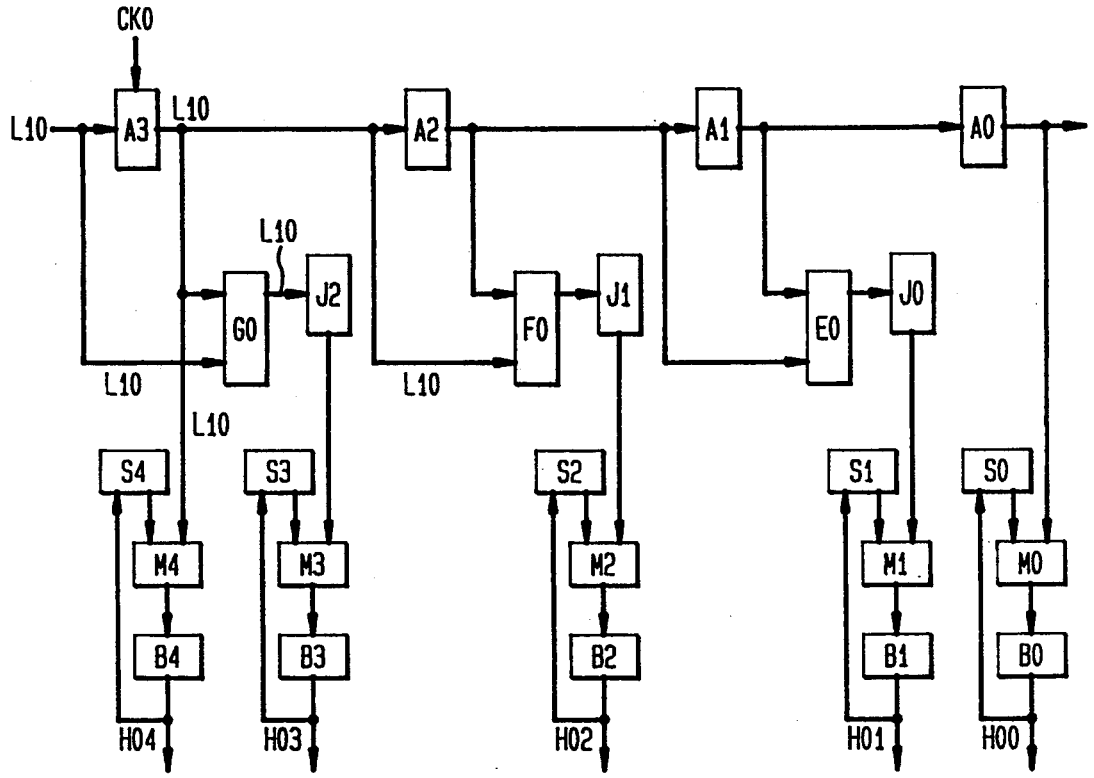
FIG. 34 is a circuit diagram showing the second stage of an operation in which the display data for low resolution is expanded also in the vertical direction and display data for the second display line is generated in the second embodiment.
Figure 35:
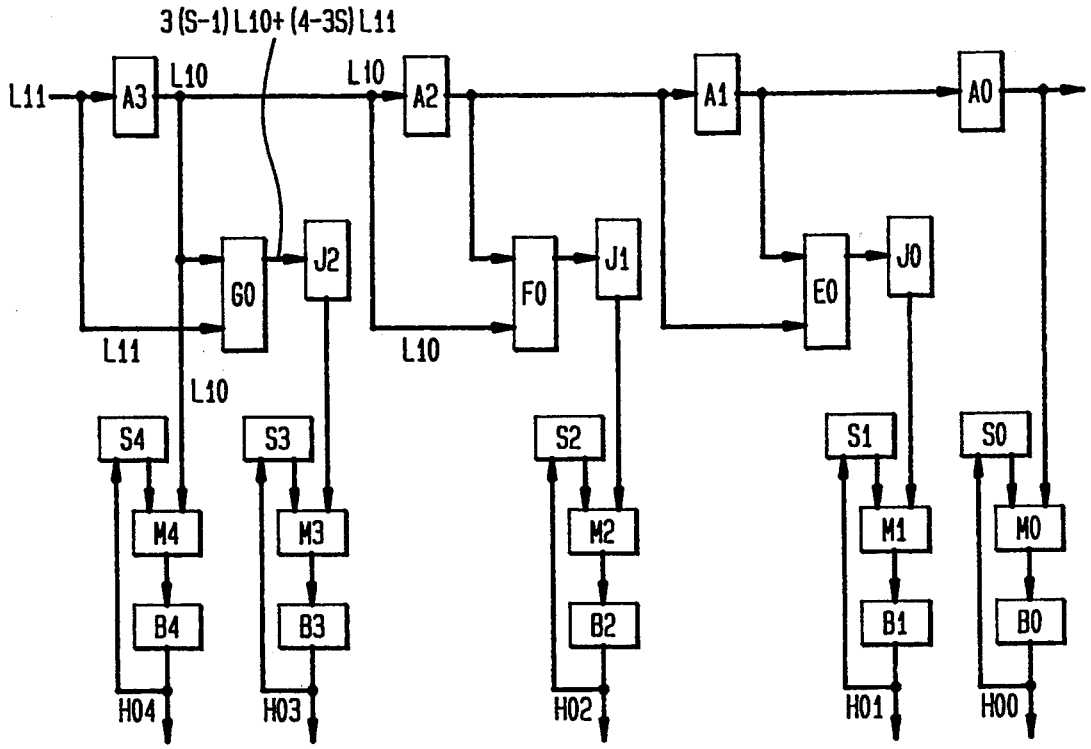
FIG. 35 is a circuit diagram showing the third stage of an operation in which the display data for low resolution is expanded also in the vertical direction and display data for the second display line is generated in the second embodiment.
Figure 36:
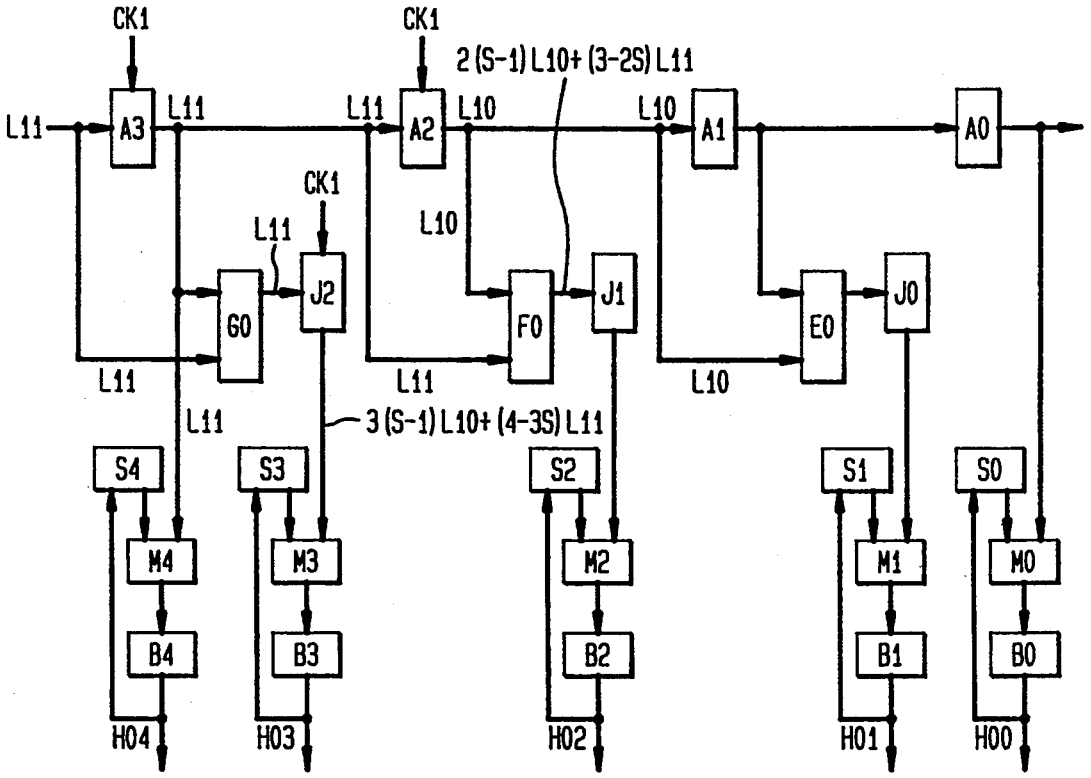
FIG. 36 is a circuit diagram showing the fourth stage of an operation in which the display data for low resolution is expanded also in the vertical direction and display data for the second display line is generated in the second embodiment.

In FIG. 34, when a first pixel clock CK0 is provided to the flip flop A3, the output of the flip flop A3 becomes the display data L10. In FIG. 35, when the display data L11 is provided to the flip flop A3, the output of the flip flop A3 continues to be the display data L10, but an output of the intermediate value generating circuit G0 becomes $3(s-1)L10+(4-3s)L11$. In FIG. 36, when a second pixel clock CK1 is provided to the flip flops A3, A2, and J2, the output of the flip flop A3 becomes L11, the output of the flip flop J2 becomes $3(s-1)L10+(4-3s)L11$, the output of the flip flop A2 becomes L10, and the output of the intermediate valve generating circuit F0 becomes $2(s-1)L10+(3=2s)L11$.

Figure 37:
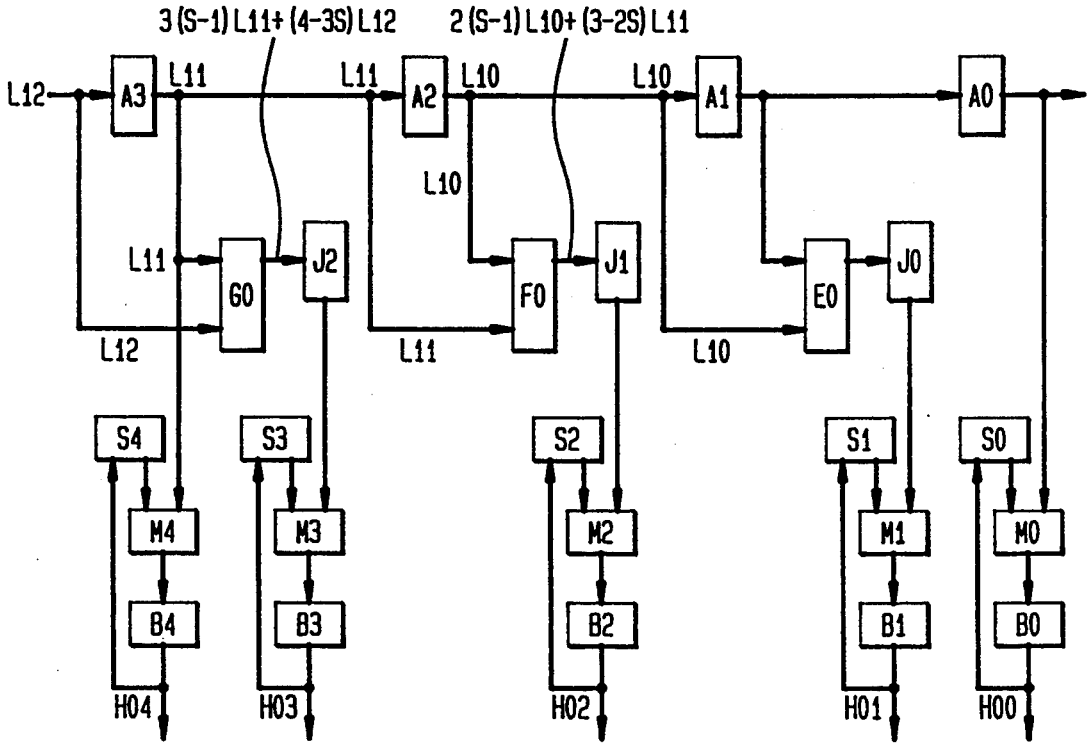
FIG. 37 is a circuit diagram showing the fifth stage of an operation in which the display data for low resolution is expanded also in the vertical direction and display data for the second display line is generated in the second embodiment.
Figure 38:
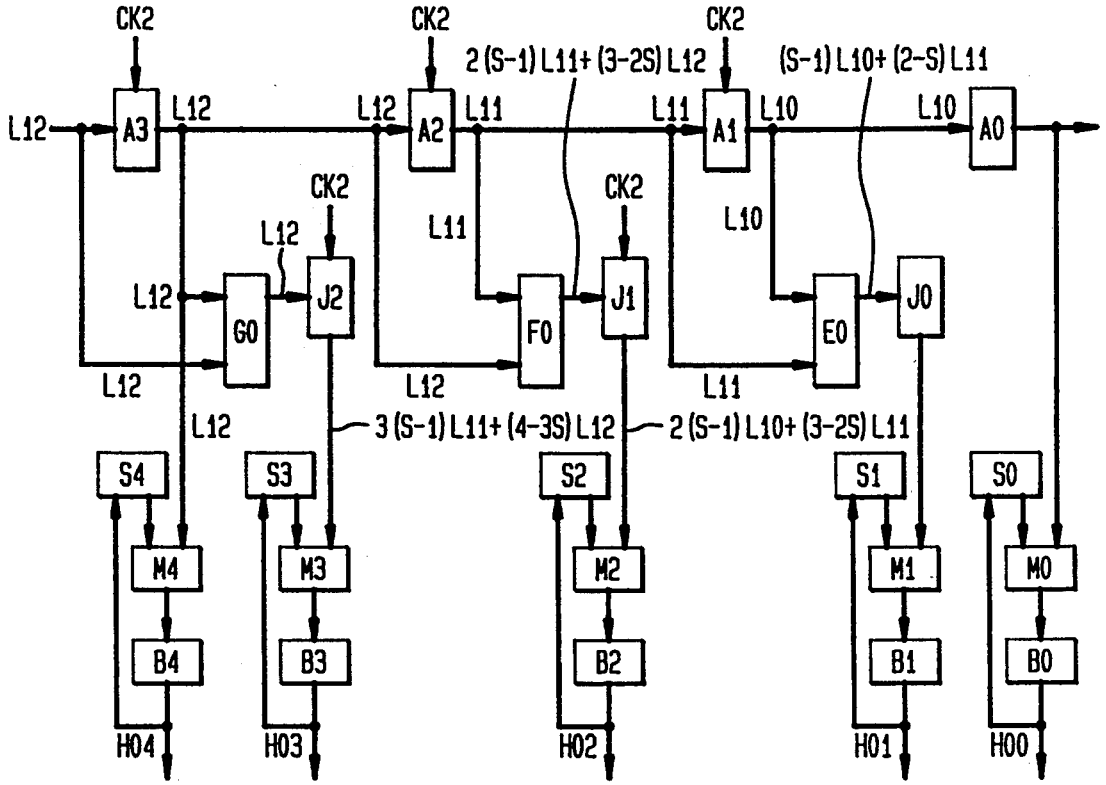
FIG. 38 is a circuit diagram showing the sixth stage of an operation in which the display data for low resolution is expanded also in the vertical direction and display data for the second display line is generated in the second embodiment.

In FIG. 37, while the display data L12 is provided to the flip flop A3, it is provided to one of two inputs of the intermediate value generating circuit G0 on the output side of the flip flop A3. The output of the intermediate value generating circuit G0 becomes $3(s-1)L11+(4-3s)L12$, and the output of the intermediate value generating circuit F0 becomes $2(s-1)L10+(3-2s)L11$. In FIG. 38, when a third pixel clock CK2 is provided to the flip flops A3, A2, A1, J2, and J1, the output of the flip flop A3 becomes L12, the output of the flip flop J2 becomes $3(s-1)L11+(4-3s)L12$, the output of the flip flop A2 becomes L11, the output of the flip flop J1 becomes $2(s-1)L10+(3-2s)L11$, and the output of the flip flop A1 becomes L10.

Figure 39:
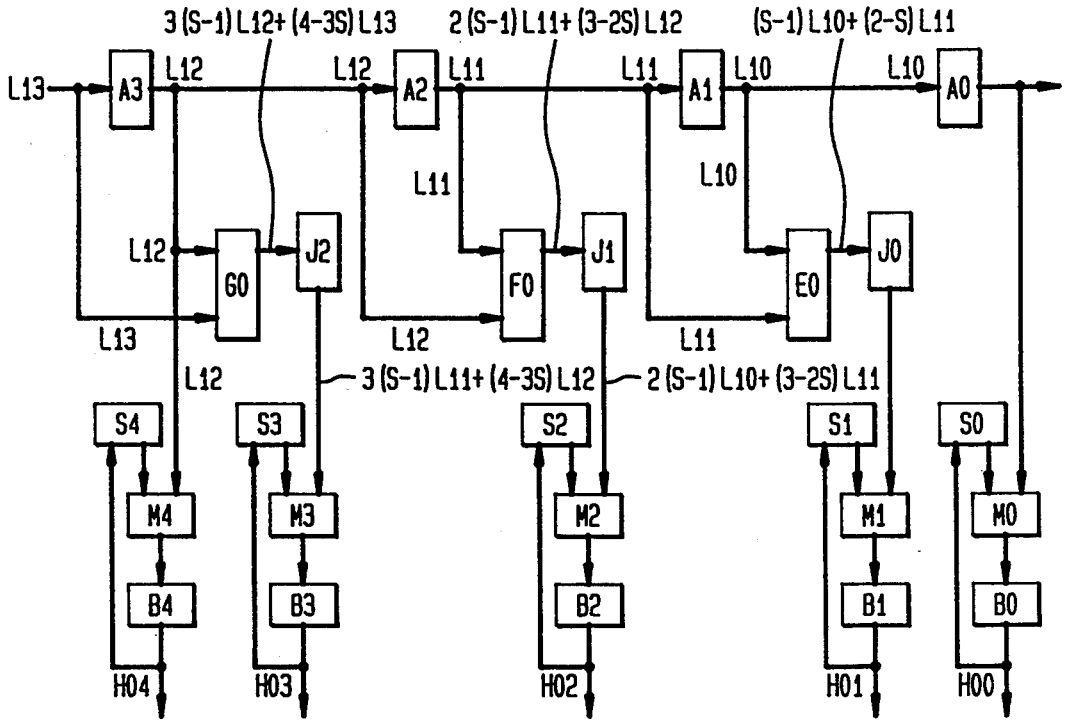
FIG. 39 is a circuit diagram showing the seventh stage of an operation in which the display data for low resolution is expanded also in the vertical direction and display data for the second display line is generated in the second embodiment.

In FIG. 39, while the display data L13 is provided to the flip flop A3, it is provided to one of two inputs of the intermediate value generating circuit G0 on the output side of the flip flop A3. The output of the intermediate value generating circuit G0 becomes $3(s-1)L12+(4-3s)L13$.

Figure 40:
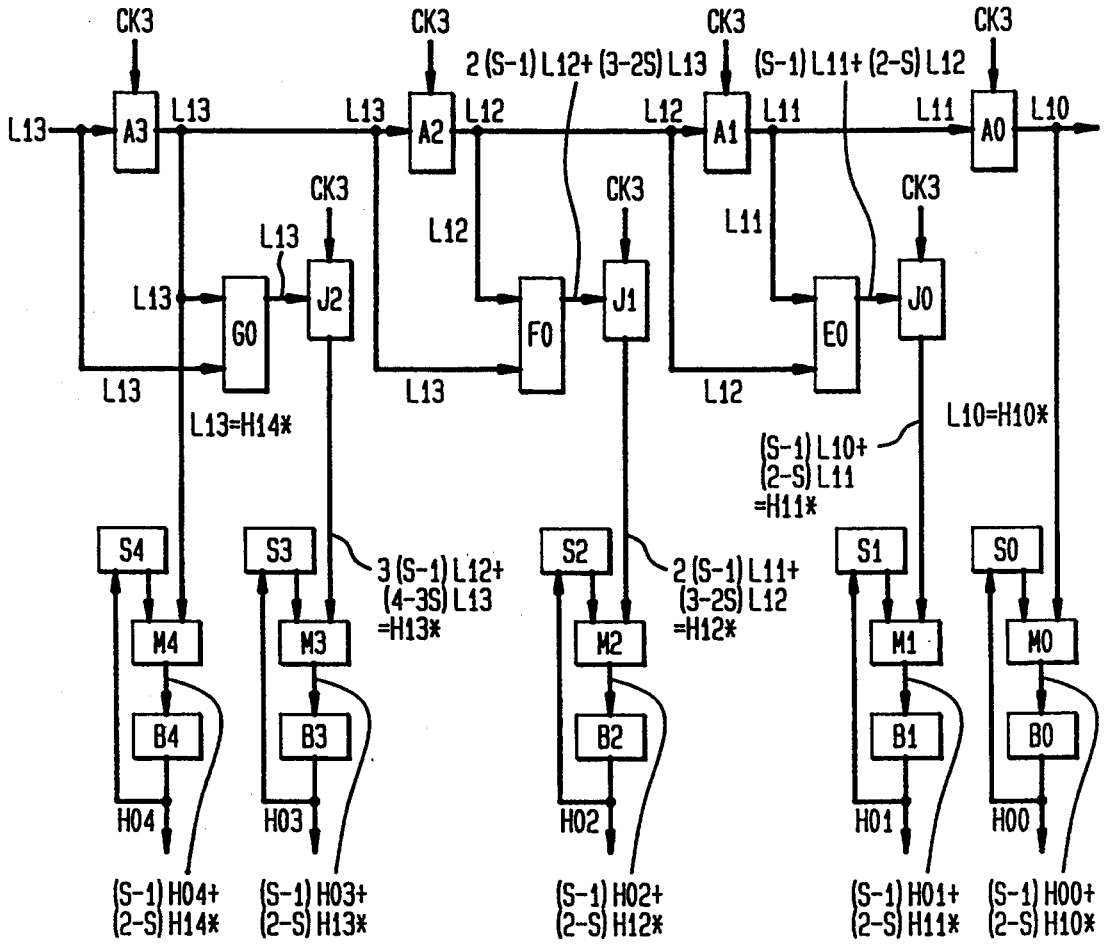
FIG. 40 is a circuit diagram showing the eighth stage of an operation in which the display data for low resolution is expanded also in the vertical direction and display data for the second display line is generated in the second embodiment.

In FIG. 40, when a fourth pixel clock CK3 is provided to the flip flops A3, A2, A1, A0, J2, J1, and J0, the output of the flip flop A3 becomes L13, the output of the flip flop J2 becomes $3(s-1)L12+(4-3s)L13$, the output of the flip flop A2 becomes L12, the output of the flip flop J1 becomes $2(s-1)L11+(3-2s)L12$, the output of the flip flop A1 becomes L11, the output of the flip flop J0 becomes $(s-1)L10+(2-s)L11$, and the output of the flip flop A0 becomes L10.

Now, if it is assumed that $L13=H14^*$, $3(s-1)L12+(4-3s)L13=H13^*$, $2(s-1)L11+(3-2s)L12=H12^*$, $(s-1)L10+(2-s)L11=H11^*$, and $L10=H10^*$, $H14^*$, $H13^*$, $H12^*$, $H11^*$, and $H10^*$ are respectively provided to one of two inputs of each of the variable intermediate value generating circuits M4, M3, M2, M1, and M0, and, H04, H03, H02, H01, and H00 are respectively provided to the other of two inputs of each of the variable intermediate value generating circuits M4, M3, M2, M1, and M0. The variable intermediate value generating circuits M4, M3, M2, M1, and M0 perform a predetermined operation for said two inputs in response to a line counter pulse LC and output $(s-1)H04+(2-s)H14^*$, $(s-1)H03+(2-s)H13^*$, $(s-1)H02+(2-s)H12^*$, $(s-1)H01+(2-s)H11^*$, $(s-1)H00+(2-s)H10^*$, respectively.

Figure 41:
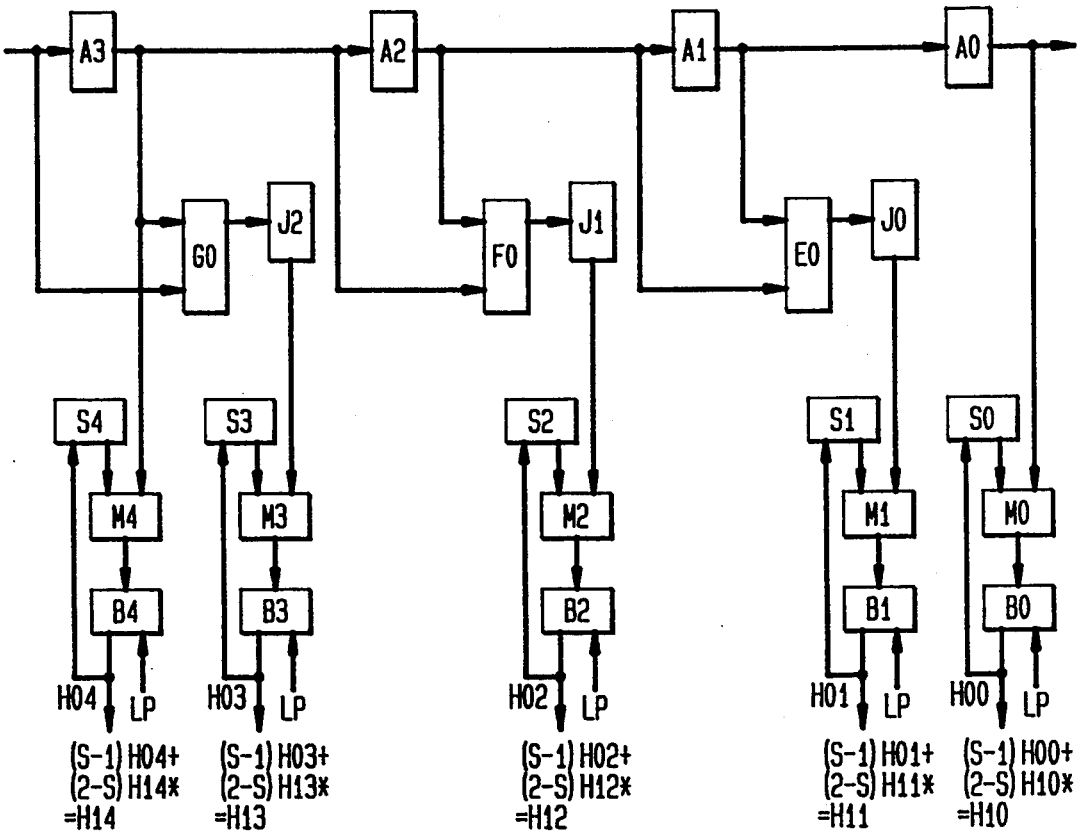
FIG. 41 is a circuit diagram showing the ninth stage of an operation in which the display data for low resolution is expanded also in the vertical direction and display data for the second display line is generated in the second embodiment.

In FIG. 41, when a latch pulse LP is simultaneously provided to each of the flip flops B4, B3, B2, B1, and B0 of the line data latch 132, the flip flops B4, B3, B2, B1, and B0 output $(s-1)H04+(2-s)H14^*$, $(s-1)H03+(2-s)H13^*$, $(s-1)H02+(2-s)H12^*$, $(s-1)H01+(2-s)H11^*$, $(s-1)H00+(2-s)H10^*$, respectively.

Now, if it is assumed that the five display data for high resolution are H14, H13, H12, H11, and H10, then $H14=(s-1)H04+(2-s)H14^*$, $H13=(s-1)H03+(2-s)H13^*$, $H12=(s-1)H02+(2-s)H12^*$, $H11=(s-1)H01+(2-s)H11^*$, and $H10=(s-1)H00+(2-s)H10^*$ are established as described above. These display data for high resolution are outputted to the five signal electrodes y4, y3, y2, y1, and y0 of a high-resolution display apparatus. Simultaneously, a scan signal is applied to the second scanning electrode x1 corresponding to the second display line of a plurality of the scanning electrodes x0, x1, x2, x3 . . . , and display is presented in the second display line based on the display data H14, H13, H12, H11, and H10 for high resolution.

Figure 42:
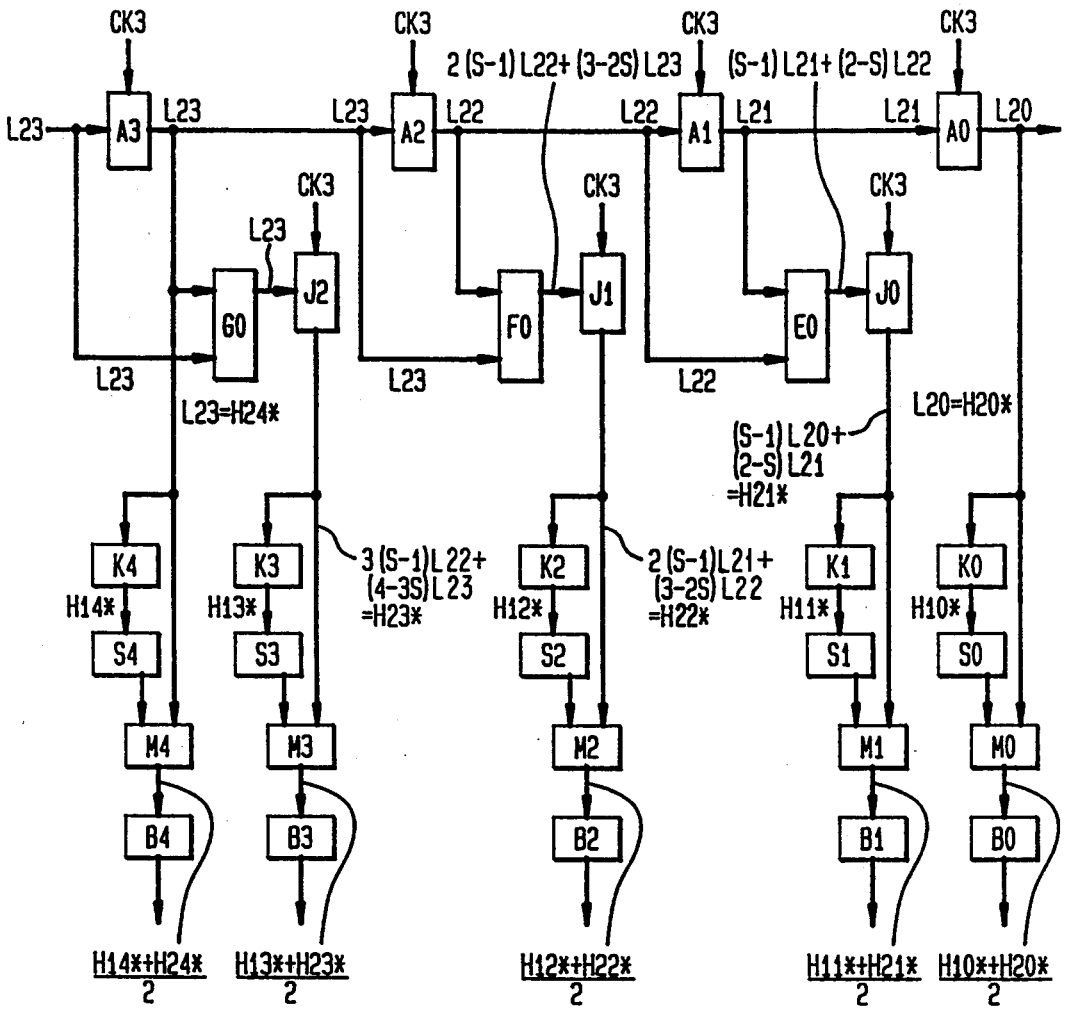
FIG. 42 is a circuit diagram showing the eighth stage of an operation in which the display data for low resolution is expanded also in the vertical direction and display data for a third display line is generated in the second embodiment.
Figure 43:
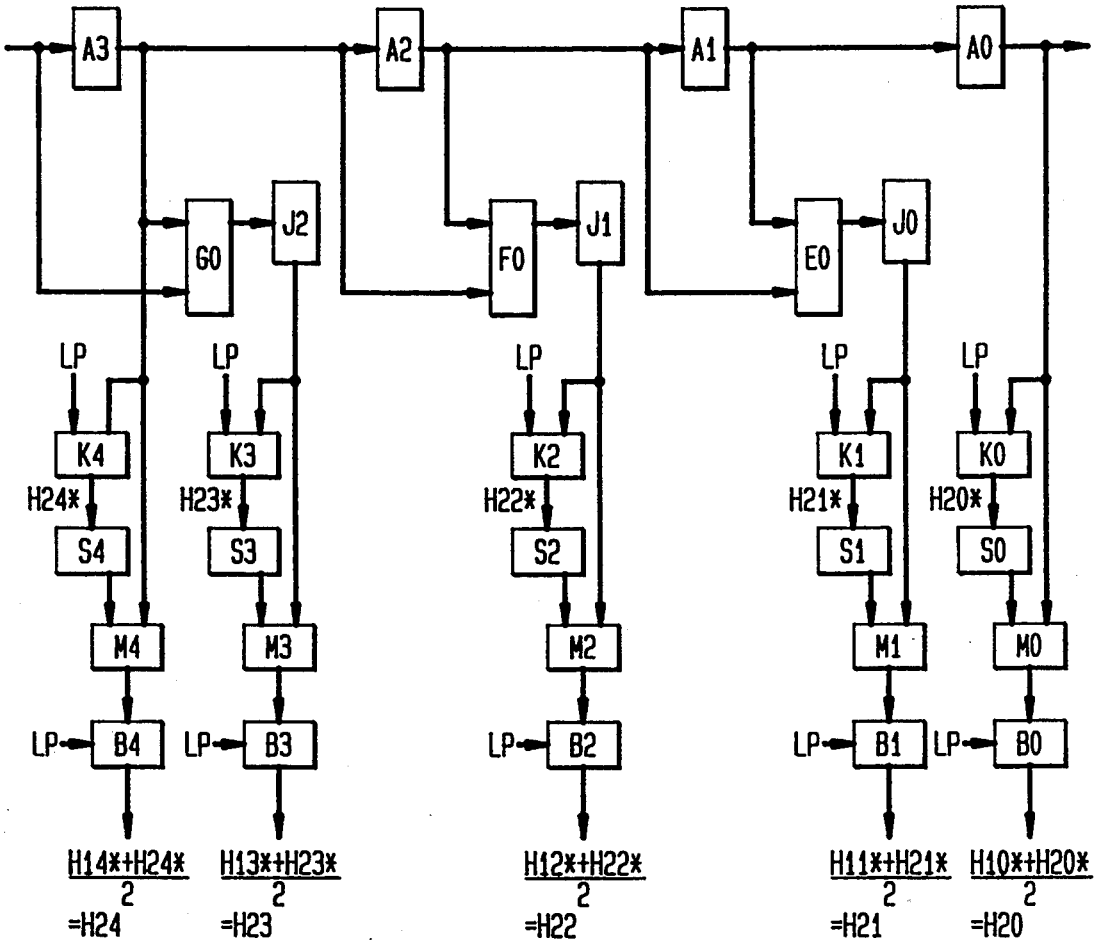
FIG. 43 is a circuit diagram showing the ninth stage of an operation in which the display data for low resolution is expanded also in the vertical direction and display data for the third display line is generated in the second embodiment.

FIG. 42 and FIG. 43 show the state where the display data H20, H21, H22, H23, H24 . . . of a third display line for high resolution are generated when the display data for low resolution is expanded by 1.25 times in the vertical direction as well and displayed. Now, if it is assumed that the display data of a third display line for low resolution are L20, L21, L22, L23 . . . and the display data of the third display line for high resolution are H20, H21, H22, H23, H24 . . . , the following relationship is established:

$$H20=(H10^*+H20^*)/2$$

$$H21=(H11^*+H21^*)/2$$

$$H22=(H12^*+H22^*)/2$$

$$H23=(H13^*+H23^*)/2$$

$$H24=(H14^*+H24^*)/2.$$

However, the following relationship is established:

$$H20^*=L20$$

$$H21^*=(s-1)L20+(2-s)L21$$

$$H22^*=2(s-1)L21+(3-2s)L22$$

$$H23^*=3(s-1)L22+(4-3s)L23$$

$$H24^*=L23.$$

In FIG. 42 and FIG. 43, each of the selectors S4, S3, S2, S1, and S0 selects one of two inputs which is connected to the output lines of the flip flops K4, K3, K2, K1, and K0 in response to a line counter pulse LC. The flip flops K4, K3, K2, K1, and K0 hold $H14^*$, $H13^*$, $H12^*$, $H11^*$, and $H10^*$, respectively which are generated while the display data H14, H13, H12, H11, and H10 of the second display line for high resolution are generated. Further, each of the variable intermediate value generating circuits M4, M3, M2, M1, and M0 outputs a value obtained from simply averaging two inputs in response to a line counter pulse LC.

FIG. 42 shows the state where a fourth pixel clock CK3 is provided to the flip flops A3, A2, A1, A0, J2, J1, and J0 after the display data L20, L21, L22, and L23 are sequentially provided to the flip flop A3, The output of the flip flop A3 becomes L23, the output of the flip flop J2 becomes $3(s-1)L22+(4-3s)L23$, the output of the flip flop A2 becomes L22, the output of the flip flop J1 becomes $2(s-1)L21+(3-2s)L22$, the output of the flip flop A1 becomes L21, the output of the flip flop J0 becomes $(s-1)L20+(2-s)L21$, and the output of the flip flop A0 becomes L20.

Now, if it is assumed that $L23=H24^*$, $3(s-1)L22+(4-3s)L23=H23^*$, $2(s-1)L21+(3-2s)L22=H22^*$, $(s-1)L20+(2-s)L21=H21^*$, and $L20=H20^*$, the variable intermediate value generating circuits M4, M3, M2, M1, and M0 output $(H14^*+H24^*)/2$, $(H13^*+H23^*)/2$. $(H12^*+H22^*)/2$, $(H11^*+H21^*)/2$, and $(H10^*+H20^*)/2$, respectively.

In FIG. 43, when a latch pulse LP is simultaneously provided to each of the flip flop B4, B3, B2, B1, and B0 of the line data latch 132, the flip flops B4, B3, B2, B1, and B0 output $(H14^*+H24^*)/2$, $(H13^*+H23^*)/2$, $(H12^*+H22^*)/2$, $(H11^*+H21^*)/2$, $(H10^*+H20^*)/2$, respectively.

Figure 44:
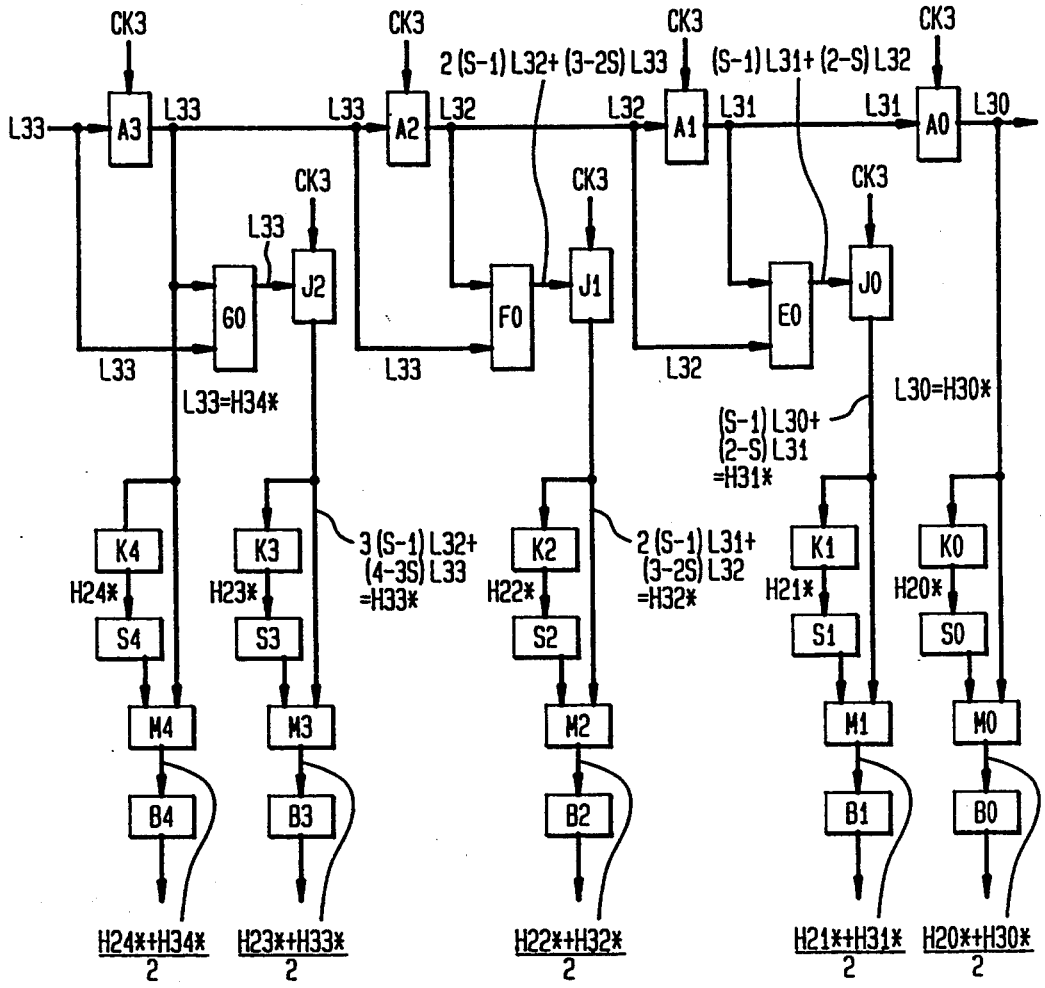
FIG. 44 is a circuit diagram showing the eighth stage of an operation in which the display data for low resolution is expanded also in the vertical direction and display data for a fourth display line is generated in the second embodiment.
Figure 45:
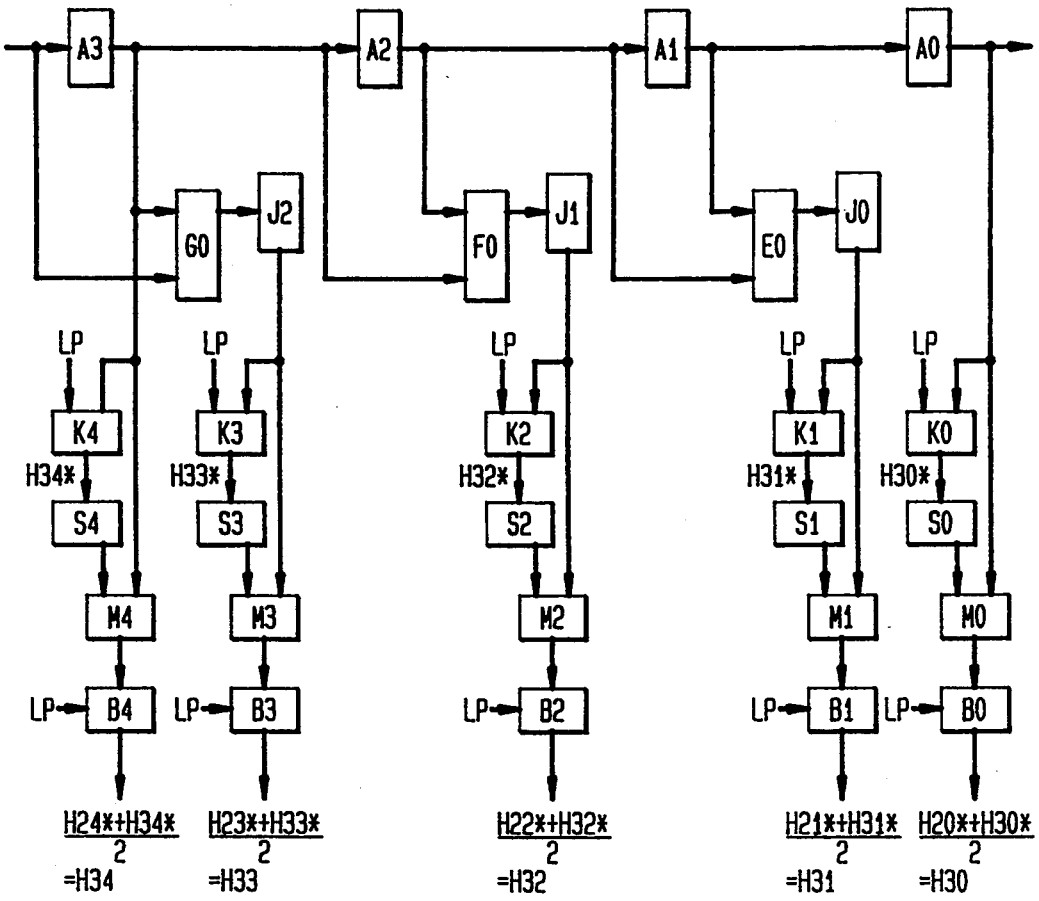
FIG. 45 is a circuit diagram showing the ninth stage of an operation in which the display data for low resolution is expanded also in the vertical direction and display data for the fourth display line is generated in the second embodiment.

FIG. 44 and FIG. 45 show the state where the display data H20, H21, H22, H23, H24 . . . of a fourth display line for high resolution are generated when the display data for low resolution is expanded and displayed by 1.25 times also in the vertical direction. Now, if it is assumed that the display data of a fourth display line for low resolution are L30, L31, L32, L33 . . . and the display data of the fourth display line for high resolution are H30, H31, H32, H33, H34 . . . the following relationship is established:

$$H30=(H20^*+H30^*)/2$$

$$H31=(H11^*+H31^*)/2$$

$$H32=(H22^*+H32^*)/2$$

$$H33=(H23^*+H33^*)/2$$

$$H34=(H24^*+H34^*)/2.$$

However, the following relationship is established:

$$H30^*=L30$$

$$H31^*=(s-1)L30+(2-s)L31$$

$$H32^*=2(s-1)L31+(3-2s)L32$$

$$H33^*=3(s-1)L32+(4-3s)L33$$

$$H34^*=L33.$$

In FIG. 44 and FIG. 45, each of the selectors S4, S3, S2, S1, and S0 selects one of two inputs, which is the output of each of the flip flops K4, K3, K2, K1, and K0 in response to a line counter pulse LC. The flip flops K4, K3, K2, K1, and K0 respectively hold H24*, H23*, H22*, H21*, and H20* which are generated while the display data H24, H23, H22, H21, and H20 of the third display line for high resolution are generated. Further, each of the variable intermediate value generating circuits M4, M3, M2, M1, and M0 outputs a value obtained from simply averaging two inputs in response to a line counter pulse LC.

FIG. 44 shows the state where a fourth pixel clock CK3 is provided to the flip flops A3, A2, A1, A0, J2, J1, and J0 after the display data L30, L31, L32, and L33 are sequentially provided to the flip flop A3. The output of the flip flop A3 becomes L33, the output of the flip flop J2 becomes 3(s−1)L32*(4−3s)L33, the output of the flip flop A2 becomes L32, the output of the flip flop J1 becomes 2(s−1)L32+(3−2s)L32, the output of the flip flop A1 becomes L31, the output of the flip flop J0 becomes (s−1)L30+(2−s)L31, and the output of the flip flop A0 becomes L30. Now, if it is assumed that L33=H34*, 3(s−1)L32+(4−3s)L33−H33, 2(s−1)L31+(3−2s)L32=H32*, (s−1)L30+(2−s)L31=H31*, and L30=H30*, then the variable intermediate value generating circuits M4, M3, M2, M1, and M0 output (H24*+H34*)/2, (H23*+H33*)/2, (H22*+H32*)/2, (H21*+H31*)/2, and (H20*+H30*)/2, respectively.

In FIG. 45, when a latch pulse LP is simultaneously provided to each of the flip flops B4, B3, B2, B1, and B0 of the line data latch 132, the flip flops B4, B3, B2, B1, and B0 output (H24*+H34*)/2, (H23*+H33*)/2, (H22*+H32*)/2, (H21*+H31*)/2, (20*+H30*)/2, respectively.

The display data H44, H43, H42, H41, and H40 of a fifth display line for high resolution are generated by expanding the display data L33, L32, L31, and L30 of the fourth display line for low resolution by 1.25 times in the horizontal direction. Since the expansion method is the same as in the case where the display data H04, H03, H02, H01, and H00 of the first display line for high resolution are generated by expanding the display data L03, L02, L01, and L00 of the first display line for low resolution by 1.25 times in the horizontal direction, its description is omitted.

Figure 46:
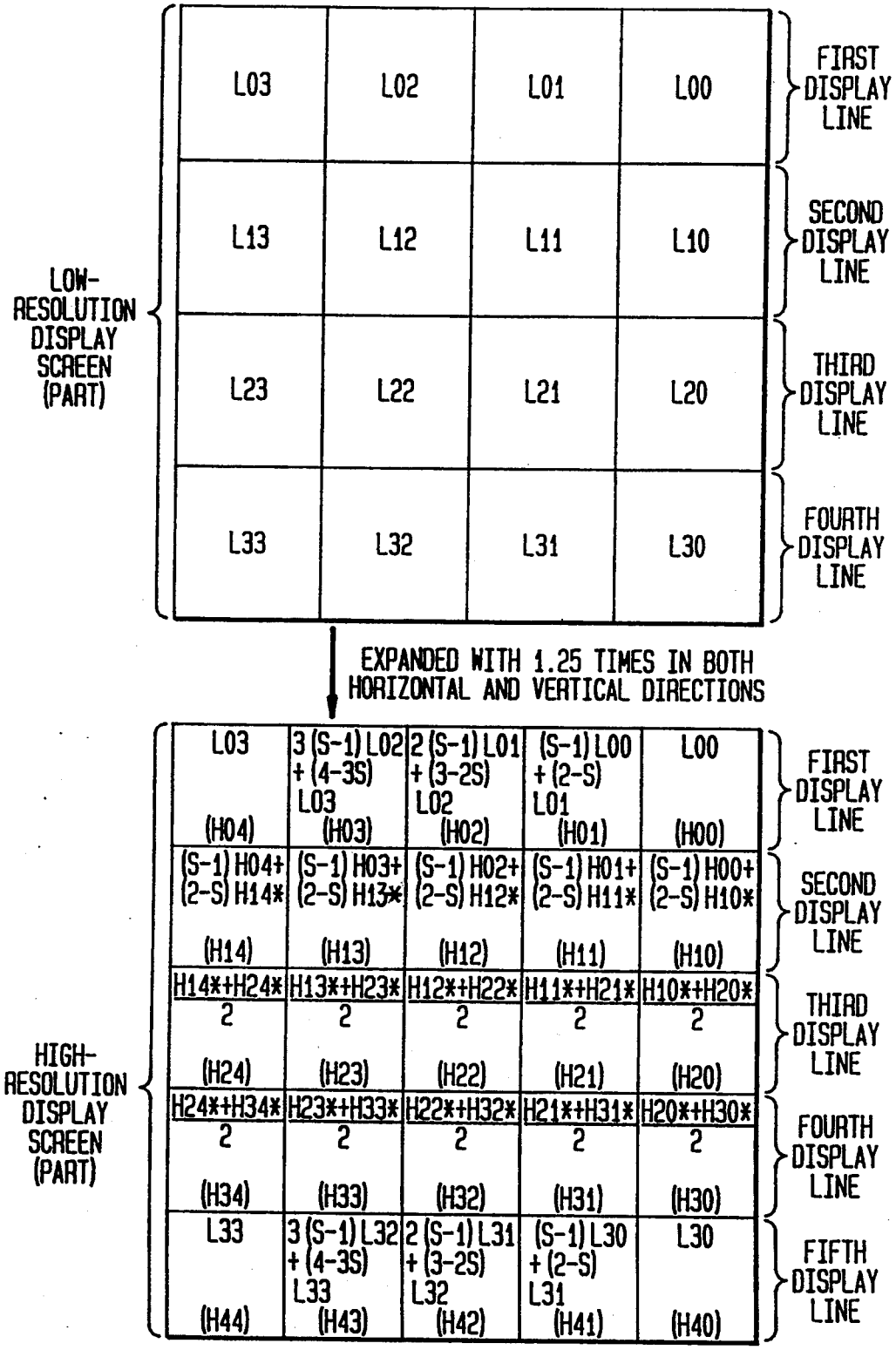
FIG. 46 is a block diagram showing a correlation between the display data for low resolution before expansion and the display data for high resolution after expansion in the second embodiment.
Figure 47:
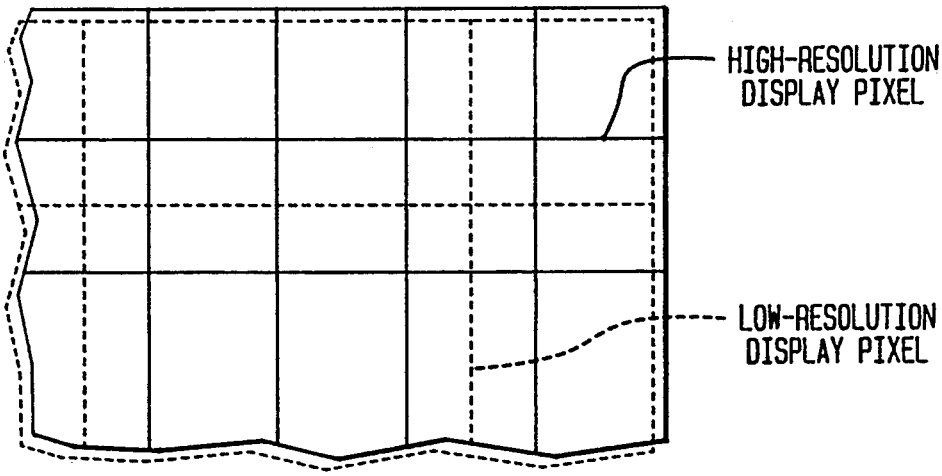
FIG. 47 is a top view showing the stage where a low-resolution display screen and a high-resolution display screen which are of the same size are superposed.
Figure 48:
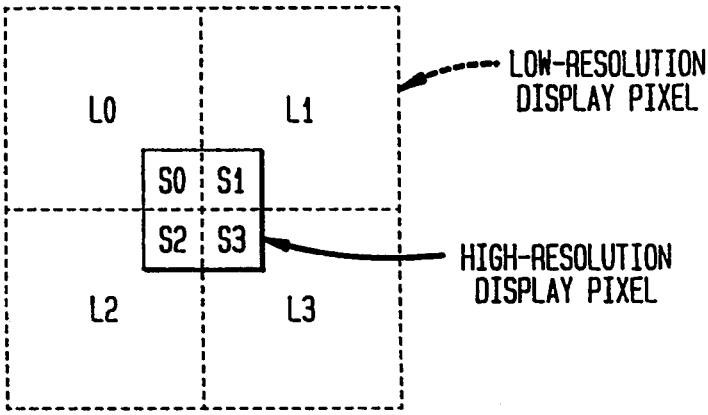
FIG. 48 is a top view showing the relationship between the brightness of pixels of high resolution and that of adjacent pixels of low resolution.

FIG. 46 shows the relationship in the second embodiment between the display data on a low-resolution display screen before expansion and the display data on a high-resolution display screen after expansion. Thus, according to the second embodiment, the display data for high resolution is generated by expanding the display data by 1.25 times in the horizontal and the vertical directions. Also in the second embodiment, the display data for low resolution is not simply duplicated, but the expansion of the display data is executed using intermediate values of adjacent display data for low resolution, and thereby the state of brightness distribution of a display screen before expansion is similar to that of brightness distribution of a display screen after expansion, and the expansion of the display data does not cause a visual difference in comparison with the original display screen.

The number of the shift clocks CK needed for data expansion is only four (in reality, 4 times n; where, n is the number of times when the configuration of illustrated sections of circuits is repeated in actual circuits) of a first shift clock to a fourth shift clock, CK0 to CK3. That is, while the display data is expanded by 1.25 times in the horizontal and the vertical directions, the number of the shift clocks CK needed for operations is the same in the case as where the display data is shifted in the shift register 130 without being expanded.

Though the display data is expanded by 1.5 times in the horizontal and the vertical directions in the first embodiment and is expanded by 1.25 times in the horizontal and the vertical directions in the second embodiment, the display data may be expanded only either in a horizontal direction or in a vertical direction. Further, it will be appreciated that the present invention may be applied to the expansion of the display data with ratios other than ratios shown in said embodiments. That is, the display data can be expanded by various ratios by changing an interval of a rate at which intermediate value generating circuits are provided to a plurality of flip flops which are merely connected in a row in a shift resistor and by changing an intermediate value which an intermediate value generating circuit generates and outputs based on the display data of the input side and that of the output side of a flip flop to which the intermediate value generating circuit is connected. Further, if an intermediate value of the display data for low resolution is also displayed as described in said embodiments while the display data for low resolution remains intact to overlap a plurality of pixels of a high-resolution display apparatus, a display data can be also expanded with the ratio of more than two.

What is claimed is:

1. A circuit for driving a matrix display panel having a plurality of signal electrodes and a plurality of scanning electrodes crossing the signal electrodes, on which display regions are formed near intersections defined by the signal electrodes and the scanning electrodes; comprising: a shift register into which display data are sequentially sent in response to a pixel clock until display data for one display line is received, the shift register having a plurality of first flip flops connected in series, and a plurality of second flip flops connected to the outputs of at least a portion of the first flip flops, intermediate value generating circuits for generating intermediate values between display data on the input sides and display data on the output sides of the first flip flops, said intermediate value generating circuits supplying outputs to inputs of the second flip flops, means for applying the pixel clock simultaneously to the first and the second flip flops, and a line data latch having inputs connected to each output of the first and the second flip flops and outputs connected to said signal electrodes.

2. The circuit for driving a matrix display panel according to claim 1, wherein intermediate value generating circuits for generating intermediate values between display data previously outputted to the signal electrodes and display data newly received in the shift register and for applying the intermediate values to the signal electrodes are connected between said shift register and said signal electrodes.

3. A dot matrix display apparatus comprising:

a matrix display panel having a plurality of signal electrodes and a plurality of scanning electrodes crossing the signal electrodes, on which display regions are formed near intersections defined by the signal electrodes and the scanning electrodes, a shift register into which display data are sequentially sent in response to a pixel clock until display data for one display line is received, a line data latch for applying the display data for one display line sent from the shift register to the signal electrodes in response to line pulses, and scanning electrode driving means for selecting scanning electrodes in response to said line pulses; wherein said register has a plurality of first flip flops connected in series, second flip flops connected to the output sides of at least a portion of the first flip flops, intermediate value generating circuits for generating intermediate values between display data on the input sides and display data on the output sides of the first flip flops, said intermediate value generating circuits supplying outputs to inputs of the second flip flops, means for applying the pixel clock simultaneously to the first and the ssecond flip flops, and said line data latch is connected so as to apply each output of the first and the second flip flops to a signal electrode.

4. The matrix display apparatus caccording to claim 3, wherein intermediate value generating circuits of regenerating intermediate values between display data previously outputted to the signal electrodes and display data newly received in the shift register and for applying the intermediate values to the signal electrodes are connected between said shift register and said signal electrodes.

5. An information processing system comprising:

a CPU for performing arithmetic operations.

a system memory for storing a program executed by the CPU and data used by the program, a matrix display apparatus including a matrix display panel having signal electrodes and a circuit for driving said panel, a display controller for sending control signals and display data to said driver circuit, and a video buffer memory which holds display data for a display apparatus having resolution which is relatively lower than that of said matrix display panel and which is accessible from the CPU and the display controller; wherein said driver circuit has a shift register into which display data are sequentially sent in response to a pixel clock until display data for one display line is received, the shift register having a plurality of first flip flops for sequentially shifting said display data sent from the display controller, intermediate value generating circuits for generating intermediate values between display data on the input sides and display data on the output sides of said first flip flops, and second flip flops for applying said intermediate values to said signal electrodes.

* * * * *